US006003280A

United States Patent [19]

Wells

[11] Patent Number: 6,003,280

[45] Date of Patent: Dec. 21, 1999

[54] MODULAR FRAME BUILDING

[75] Inventor: Orie Wells, Placerville, Colo.

[73] Assignee: Inter-Steel Structures, Inc., Bellevue, Wash.

[21] Appl. No.: 08/952,589

[22] PCT Filed: Aug. 2, 1996

[86] PCT No.: PCT/US96/12659

§ 371 Date: Nov. 19, 1997

§ 102(e) Date: Nov. 19, 1997

[87] PCT Pub. No.: WO97/05340

PCT Pub. Date: Feb. 13, 1997

[51] Int. Cl.[6] ..... E04H 12/00

[52] U.S. Cl. ..... 52/653.1; 52/653.2; 52/690

[58] Field of Search ..... 52/648.1, 653.1, 52/653.2, 656.2, 690, 693, 694, 292, 293.3, 295, 296, 297

[56] References Cited

U.S. PATENT DOCUMENTS

| | | | |
|---|---|---|---|
| 1,818,418 | 8/1931 | Millard | 52/653.1 X |
| 1,850,118 | 3/1932 | Meyers | 52/653.1 X |
| 2,067,403 | 1/1937 | Lea | 52/693 X |
| 2,445,491 | 7/1948 | Moloney | 52/653.1 X |
| 2,871,997 | 2/1959 | Simpson et al. | 52/653.1 X |
| 3,213,580 | 10/1965 | Mark | 52/292 |
| 3,664,513 | 5/1972 | Atwater | 52/653.1 X |
| 5,657,606 | 8/1997 | Ressel et al. . | |

FOREIGN PATENT DOCUMENTS

| | | | |
|---|---|---|---|
| 2602533 | 2/1988 | France | 52/648.1 |
| 2674552 | 10/1992 | France | 52/648.1 |
| 2273310 | 6/1994 | United Kingdom | 52/648.1 |

*Primary Examiner*—Creighton Smith
*Attorney, Agent, or Firm*—J. Michael Neary

[57] ABSTRACT

A building frame resistant to earthquakes, wind loads, fire, insects and rot includes a peripheral frame wall made of side wall frame modules bolted together along adjacent edges, and end wall modules bolted together along adjacent edges and to the ends of the connected side wall modules. The side wall frame modules are constructed of rectangular steel tubing jig welded together off site at precisely 90° angles so that the assembled building frame is square and true. Diagonal bracing is built into selected side and end wall modules as required for the desired degree of wind resistance. Trusses for supporting a roof on the peripheral wall, also made of rectangular steel tubing, are assembled and welded, and the trusses and wall modules are trucked to the building site. The trusses are fitted at their ends into pockets on top of the side walls at the junctions between adjacent side wall modules and bolted in place where they are vertically supported on the adjoining end members of adjacent side wall modules to secure the roof of the building on the peripheral wall. Anchors set in a foundation are positioned at intersections of the frame modules to complete a vertical tensile load path from the roof to the foundation for holding the roof down in high winds, and to secure the building frame to the foundation against lateral forces exerted by wind loads or earthquakes.

21 Claims, 26 Drawing Sheets

MODULAR FRAME BUILDING

This is related to U.S. Provisional Application No. 60/001,777 filed on Aug. 2, 1995, and International Application No. PCT/US96/12,659 filed on Aug. 2, 1996, both entitled "Modular Frame Building".

This invention relates to modular frames for buildings and buildings constructed from such frames, and more particularly to high quality buildings that can be erected quickly and at low cost from tubular steel modular frame units that are fabricated off site and trucked to the building site where they are bolted together into a building frame by a small work crew without the use of heavy equipment.

BACKGROUND OF THE INVENTION

Conventional building practice for residence housing relies primarily on wood frame construction in which the building frame is constructed on site from framing lumber cut to fit piece-by-piece individually. It is a labor intensive process and demands considerable skill from the carpenters to produce a structure that has level floors, perfectly upright walls, square corners and parallel door and window openings. Even when the building frame is constructed with the requisite care and skill, it can become skewed by warping of the lumber, especially modern low grade lumber produced on tree farms with hybrid fast-growth trees.

Although conventional wood frame buildings require very little equipment for construction, they have become quite costly to build. The labor component of the cost is substantial, partly because of the straight wages that must be paid for the long laborious process of constructing the frame, and partly because of the many government mandated extra costs such as workman's compensation and liability insurance, social security payments, medical insurance premiums, and the host of reports that must be made to the Government by employers. Accordingly, employers now seek to minimize their work force by whatever means is available to minimize these burdensome costs.

Steel frame construction is commonly used on commercial buildings because of its greater strength, fire resistance and architectural design flexibility. The parts of the such a steel frame are typically built to order in accordance with the architect's plans, then trucked to the building site and assembled piece-by-piece with the use of a portable crane. The building can be made precisely and as strong as needed, but the cost is relatively high because of the skilled crew and expensive equipment need to assemble the building. It is a construction technique generally considered unsuitable for single family residence building because the cost is high and the building walls are substantially thicker than those made using standard frame construction, so standard door and window units do not fit properly and must be modified with special trim that rarely produces an aesthetic appearance.

Earthquake damage is becoming a matter of increasing concern among homeowners because of the publicity given to damage and loss of life in recent earthquakes in the U.S. and abroad. Earthquake preparedness stories and advice abound, but an underlying unresolved concern is that conventional wood frame homes in the past were not built to tolerate the effects of an earthquake, neither in its ultimate load-bearing capability nor its serviceability limits. Modern building codes attempt to address this concern, but the measures they require merely add to the already high cost of a new home and may not always provide significantly improved resistance to earthquake damage, particularly with respect to after-quake serviceability.

Fire often follows an earthquake, as happened in the disastrous Kobe earthquake of 1994, and of course fire is a major threat to homes independent of earthquake. When fire breaks out in a conventional home, the wood frame fuels the fire and reduces the chances of successfully extinguishing it before the entire structure is destroyed. The major life saving advance in the recent past is the fire alarm which detects the fire and merely alerts the occupants that a fire has started so they may escape before burning up with the house, but significant improvements to the fire resistance of the home itself that would retard the spread of the fire would be desirable.

The other major catastrophic threat to homes is wind. Wind loads on wood frame homes have destroyed many homes, primarily because the roof is usually attached so weakly to the walls that the combination of lift, exerted upward on the roof by the Bernoulli effect of the wind flowing over the roof, and pressure under the eves tending to lift the roof off the walls, wrenches the roof off the walls and allows the wind to carry the roof away like a big umbrella.

Termite and carpenter ant damage to wood frame homes is a major form of damage, costing many millions of dollars per year. Although the damage done by insects is rarely life threatening, it is actually more extensive in total than the combined effects of wind and earthquake, and it is an ever present danger in many parts of the country.

Thus, there exists an increasing need for a home building frame design that would enable the inexpensive construction of homes that are highly tolerant of the effects of earthquakes, do not support combustion, are capable of withstanding high winds, are immune to damage from insects, and can use standard building components such as door and window units. Such a building frame concept would be even more commercially valuable if it were possible to erect the building in a short time with a small crew and without heavy equipment, and the frame could be adapted to produce buildings of attractive building styles desired locally.

SUMMARY OF THE INVENTION

Accordingly, it is an object of this invention to provide an improved building frame that can be assembled rapidly at the building site by bolting together metal frame modules fabricated off site. Another object of this invention is to provide an improved metal frame for a house that can be made to withstand severe earthquakes and high winds yet be much less costly than comparable wood frame houses. Yet another object of this invention is to provide an improved process for constructing a frame for a house that is less costly than conventional wood frame houses and substantially more resistant to damage from earthquakes and wind. A further object of this invention is to provide an improved steel frame home building having walls the same thickness as conventional wood frame homes so that standard door and window units can be used with normal appearance, but the building has the strength and fire resistant benefits of a steel frame building while costing less than conventional wood frame buildings.

These and other objects of the invention are attained in a building frame for a building able to withstand severe earthquakes and gale-force wind loads, including side walls made of side wall frame modules bolted together along adjacent edges and end walls made of end wall frame modules bolted together along adjacent edges. The frame modules are constructed of rectangular steel tubing, typically 2"×2", welded together in a welding jig to ensure exact 90° angles. At least some of the side and end wall frame modules have diagonal bracing to provide rigidity against wind loads and folding forces experienced during earthquakes. The end walls are each bolted at their ends to ends of the side walls to form a peripheral wall of the building. Trusses for supporting a roof on the peripheral wall are bolted into pockets on top of the side walls between structural members at the top of the wall to secure the roof of the building on the peripheral wall. The peripheral wall is secured to a concrete foundation by attachment of the frame modules to anchors set in a concrete foundation. The anchors have attachments for establishing a high strength tensile load path between the foundation and the frame modules. Metal studs are fastened on the inside surfaces of the wall frame modules extending vertically for attachment of interior wall board. Vertically extending stringers are attached to the outside surfaces of the wall frame modules for attachment of external siding. The roof is attached to the trusses by the use of longitudinally extending perlins attached to brackets that are pre-welded to the top of the trusses. The perlins extend over the trusses for attachment of roof sheathing. A high strength tensile load path is thus established through steel structure from the foundation through the frame to the roof for resisting high wing loading and shaking forces of earthquakes.

DESCRIPTION OF THE DRAWINGS

The invention and its many attendant objects and advantages will become better understood upon reading the following description of the preferred embodiment in conjunction with the following drawings, wherein.

DESCRIPTION OF THE PREFERRED EMBODIMENTS

Figure 1:
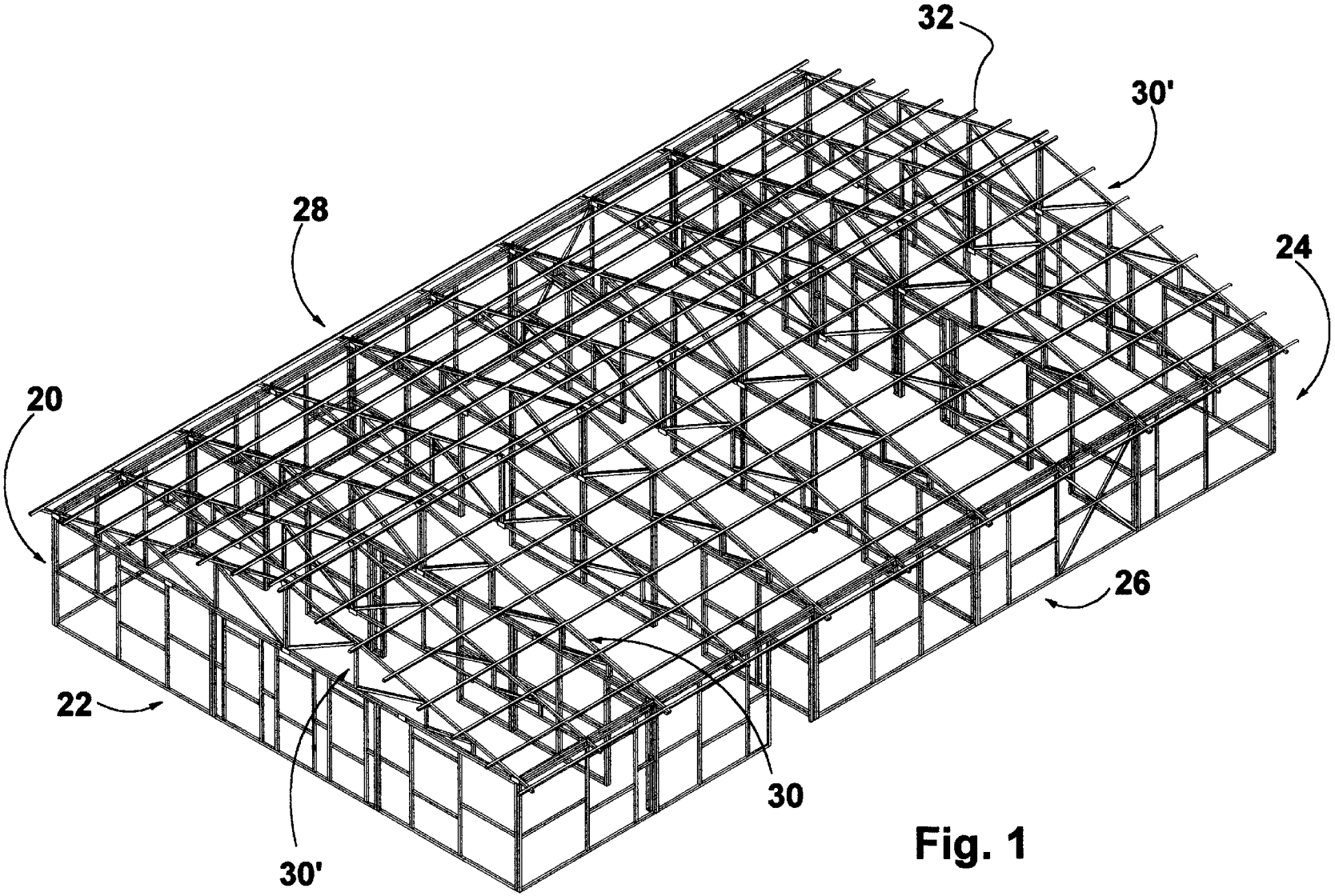
FIG. 1 is a perspective view of a building frame made in accordance with this invention.

Turning now to the drawings, wherein like reference numerals designate identical or corresponding parts, and more particularly to FIG. 1 thereof, a building frame is shown having a peripheral wall 20 made of two end walls 22 and 24 connected at their ends to ends of two side walls 26 and 28. The side walls 26 and 28 support opposite ends of a plurality of trusses 30 spaced apart along the side walls at regular intervals, and each end wall 22 and 24 supports an end truss 30'. The trusses 30 are supported in pockets 48 atop the side walls 26 and 28 and extend beyond the outside surfaces of the side walls 26 and 28 to provide an overhanging eve. A plurality of longitudinally extending purlins 32 are attached to the trusses 30 for supporting a roof 34, shown in FIG. 2.

The wall modules 36 for the end walls 22 and 24 and the side walls 26 and 28 are fabricated off site and trucked to the building site where they are bolted together into a building frame. The modules are made in a welding shop out of lengths of metal tubing, welded together at precisely 90° so that the assembled building frame is perfectly true and square when bolted together. The tubing is preferably commercially available 2"×2" galvanized square steel tubing having a wall thickness of 0.083", ASTM-A-500 with a yield strength of about 50 KSI and a tensile strength of about 55 KSI. Naturally, other material could be used, but this material is preferred because it is widely available from many sources at low cost and in various wall thicknesses for different strength requirements. The modules are preferably welded together on a welding jig that holds the lengths of tubing at the desired 90° within about 2°, or preferrably within about 1° tolerance. Care should be taken to avoid heat distortion of the assembly during welding, for example by tack welding the entire module together before completely welding the junctions. MIG welding has been found to produce clean welds that do not require de-slagging and also minimize heat input into the junction. If enough welding jigs are not available for the desired production rate, the first module may be made on the welding jig and the other identical modules may be made on top of the first as a pattern.

The preferred side wall modules 36, shown in FIGS. 3A–3E, are about eight feet square, although the dimensions can conveniently be varied for different house designs and ceiling heights if desired. The modules are preferably dimensioned to use standard interior wall board, such as that commonly sold in 4'×8' panels, so the wall may be built without extensive cutting of the wall board.

Figures 3A, 3B, 3C:
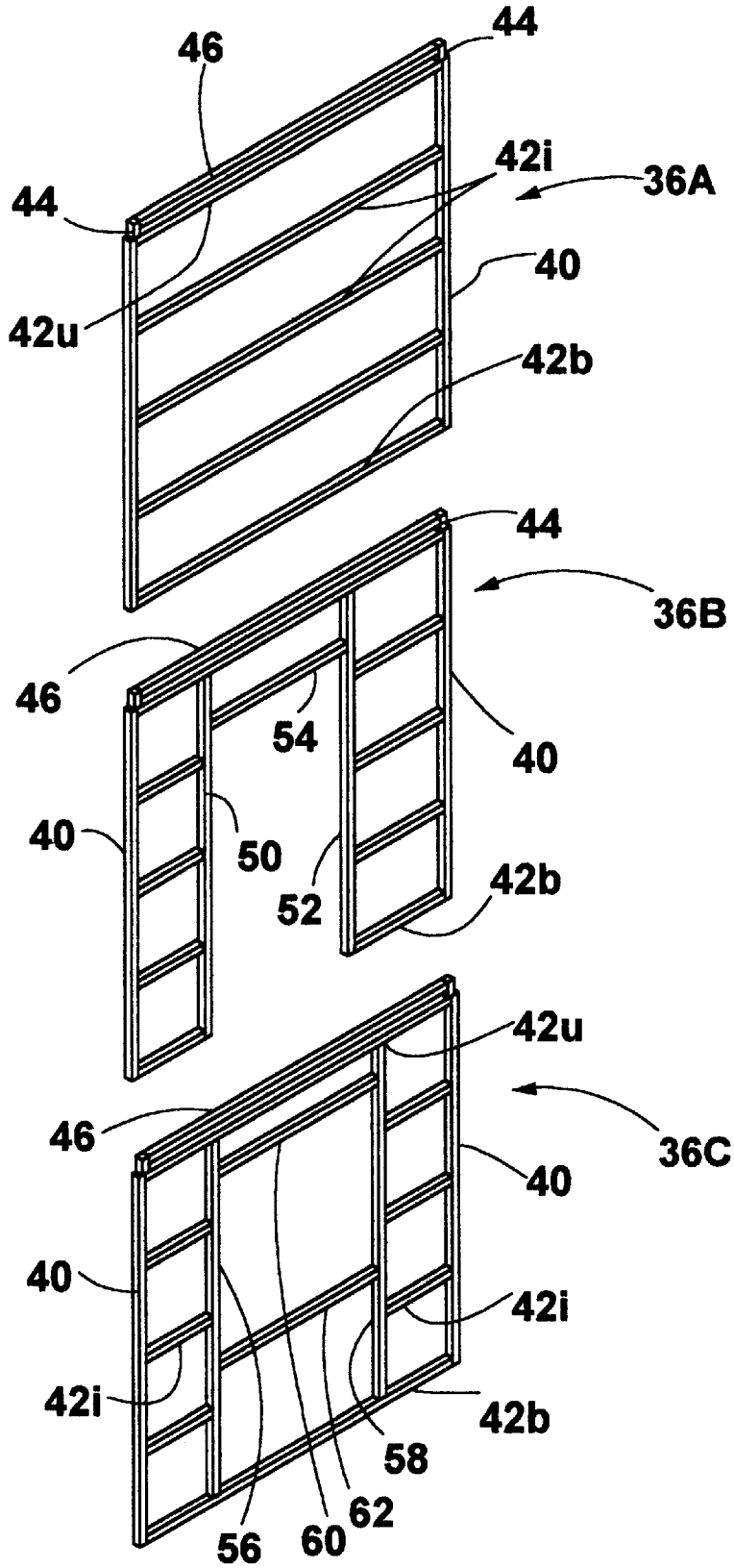
FIGS. 3A–3K are perspective and elevational views of various representative building frame wall modules for use in buildings made in accordance with this invention.

The side wall module 36A shown in FIG. 3A includes two upright end members 40 and five longitudinal or girt members 42 welded between the end members 40. The upper and lower girt members 42*u* and 42*b* are welded flush with the top and bottom of the end members 40 and extend at 90° thereto, and the three intermediate girt members 42*i* are spaced equally between the members 42*u* and 42*b* and parallel thereto. Some of the corresponding side wall modules shown in FIG. 12 use only one intermediate girt member 42*i*, which produces a wall module that is strong enough for buildings subjected to normal stresses. The extra intermediate girt member 42*i* in FIG. 3A illustrate the ease with which the frames for buildings can be designed and built for various load conditions.

Two upstanding stub members 44, made of 4" lengths of the same 2"×2" steel tubing, are welded to the upper girt member 42*u* of the side wall modules 36, and an eve strut 46 is welded between them about 2" above and parallel to the upper girt member 42*u* and flush with the top of the stub members. The stub members are each off-set from the outer edge of the end members 40 by about 1", leaving a pocket 48 about 2" wide directly over two abutting upright end members 40, shown in FIG. 4A, between adjacent stub members 44 on adjacent side wall modules 36A for receiving end portions of the trusses 30 and directly supporting the trusses 30 on the abutting upright end members 40, as will be described in more detail below. The eve strut 46 stiffens the connection of the trusses 30 to the wall modules 36 in the pocket 48 and allows the stresses exerted by the trusses on the stub members 44 to flow through the modules 36 from one side to the other. The pockets 48 in the side walls 26 and 28 are each defined by a floor 45 and opposed side surfaces 47 extending completely through the side wall from the inside face to the outside face. The floor 45 of each pocket 48 lies flush with (in fact is defined by) the top surface of the upper frame member 42*u*, which lies below the top-most surface of the side walls 26 and 28, namely, the top surface of the eve strut 46.

Figure 1A:
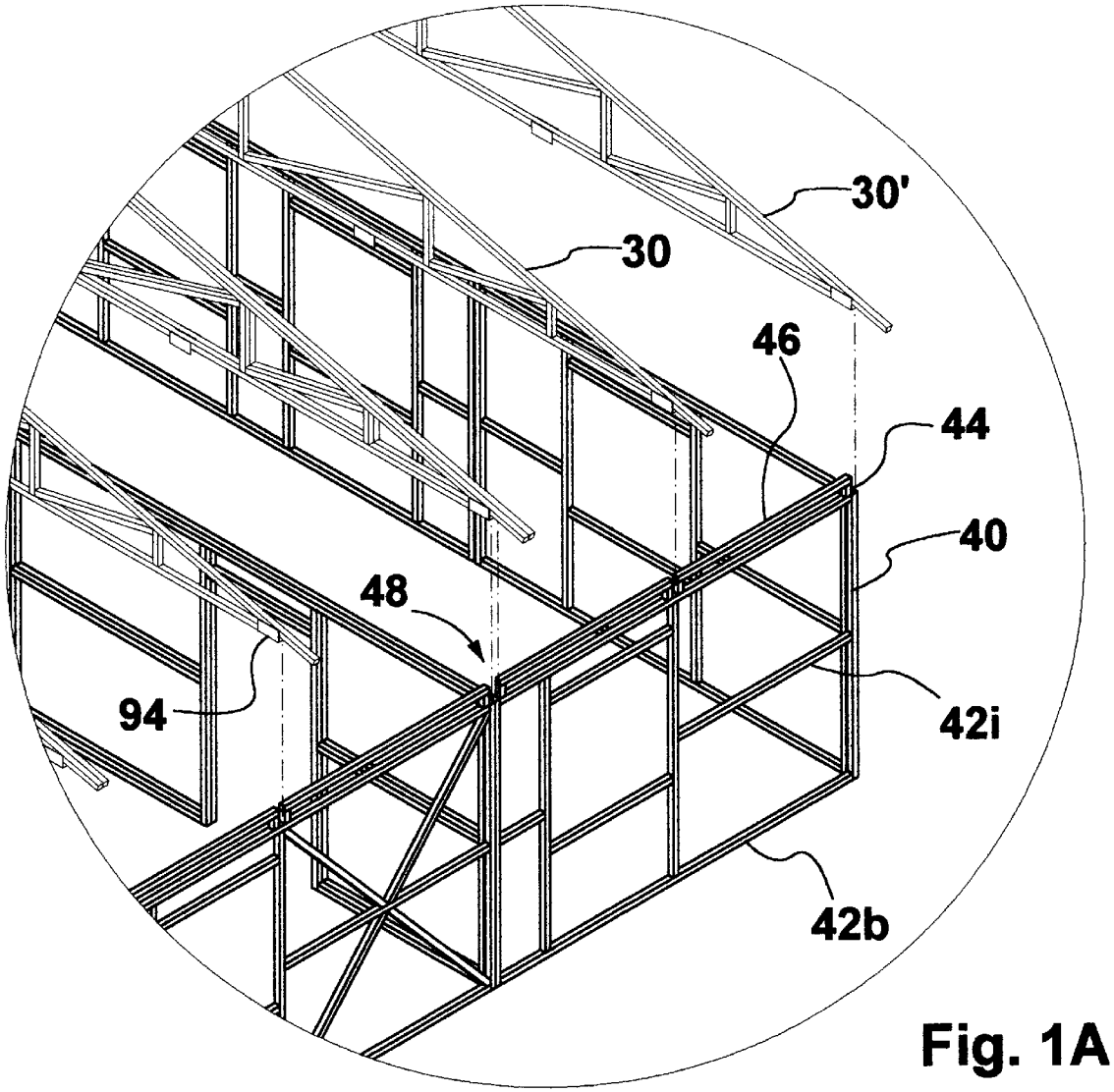
FIG. 1A is a detail of one corner of the building frame shown in FIG. 1, showing the struts exploded out of the truss pocket at the top of the building wall frame.

The building frame shown in FIGS. 1 and 1A is specially designed to be disassembled and moved in 10' wide sections. It has double trusses 30 and double interior wall frames extending parallel to the end wall frames 22 and 24. The truss pocket into which the trusses fit is twice the normal width, i.e. 4" instead of the normal 2", because the pocket holds two trusses 30 instead of just one truss. At the building site, the five sections shown can be moved into abutting position side-by-side and bolted together to complete the building frame. This is not the way a building in accordance with this invention would normally be built (described below) and is more expensive because of the extra frame modules and trusses 30, but it illustrates the versatility that the inventive building system provides.

Figure 2:
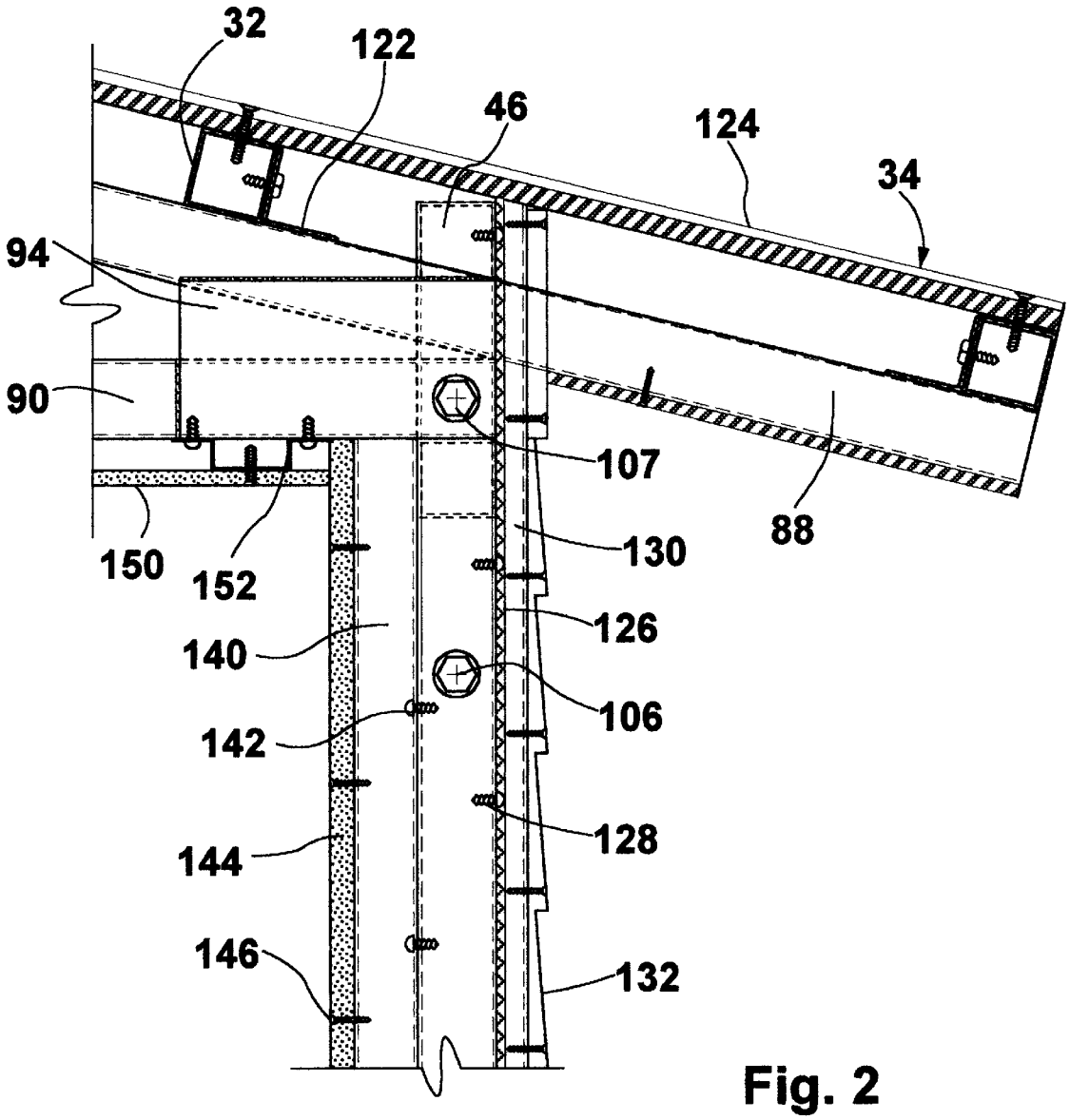
FIG. 2 is a cross sectional elevation of the eve region of a building constructed in accordance with this invention, showing a roof supported on longitudinally extending purlins attached to trusses supported on a peripheral frame wall of the building.
Figure 4:
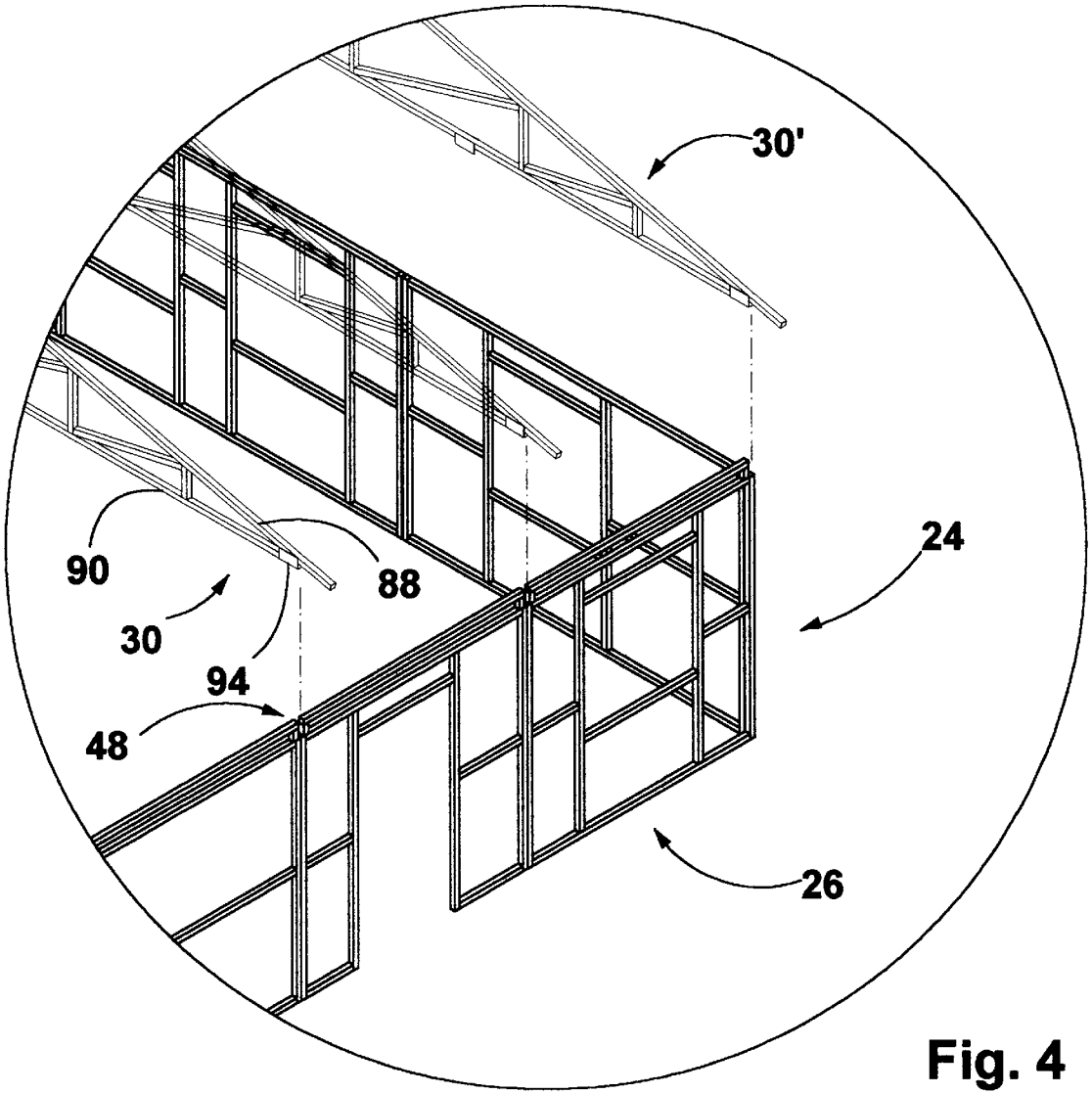
FIG. 4 is a perspective view of a corner of a building frame made in accordance with this invention with some of the wall frame modules used in the building frame shown in FIG. 1, but without the double trusses and internal wall frames shown therein.
Figure 4A:
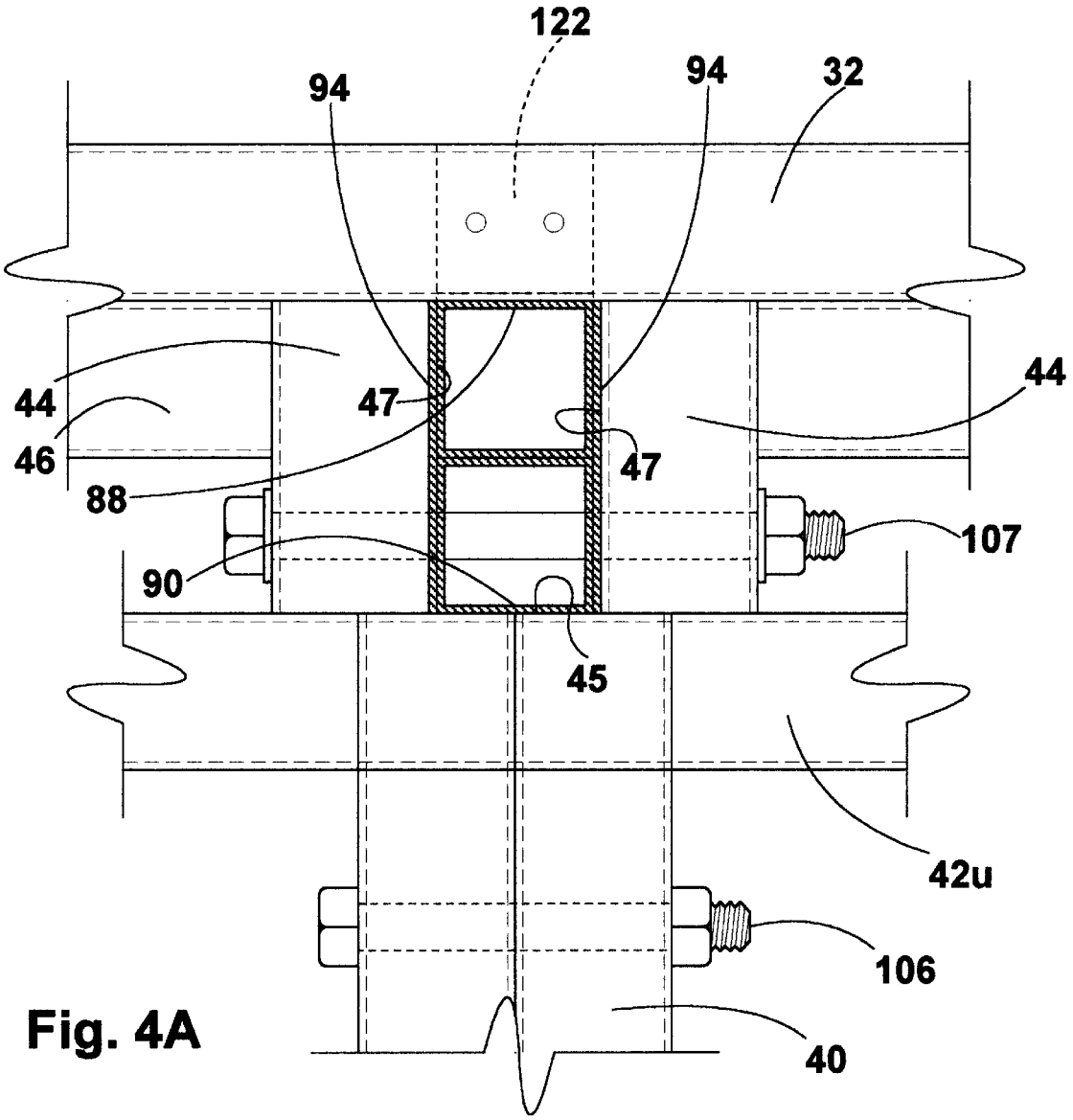
FIG. 4A is a sectional elevation showing the attachment of a truss in a pocket between the upright stub members atop two adjacent wall modules.
Figure 4B:
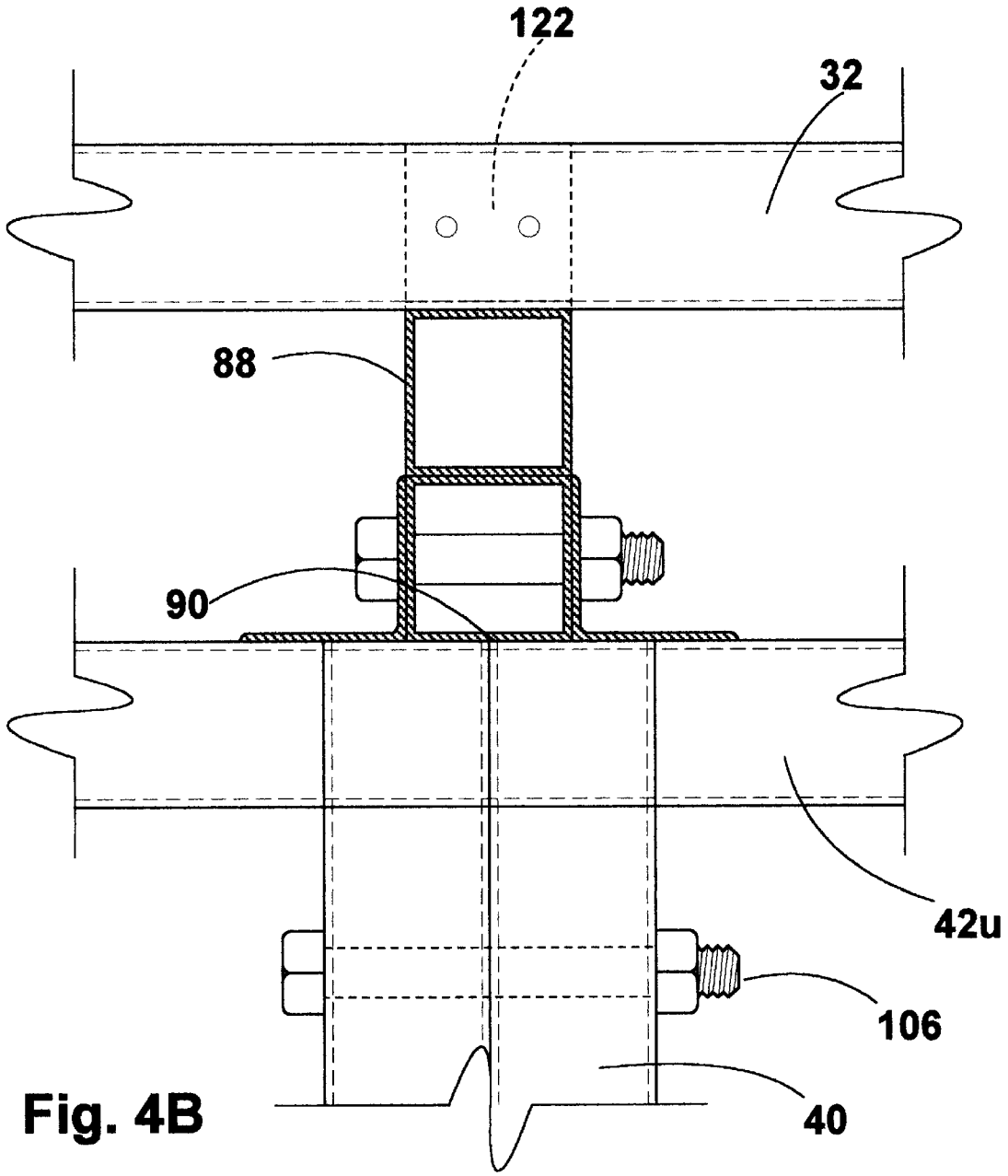
FIG. 4B is a sectional elevation through a truss where it sits on the peripheral wall, showing a modified truss attachment structure.

The pocket 48 shown in FIG. 2 is deeper by 2" than the pocket shown in FIG. 4A, achieved by using stub members 44' that are 6" long instead of 4". The longer stubs 44' raise the eve strut 46 to about the height of the upper chord of the truss 30, providing an attachment at the level of the roof sheath for the vertically extending stringers to which the exterior siding is attached. The depth of the pocket 48, or the height of the eve strut 46 above the upper girt member 42*u*, is easily designed to reach the underside of the roof sheath, which varies in height above the upper girt member 42*u* depending on the slope of the truss. The depth of the pocket is set by the length of the stub members 44 and whether the eve strut 46 is welded atop the stub members 44 or welded to the side of the stubs 44 flush with their top ends.

Figure 3D:
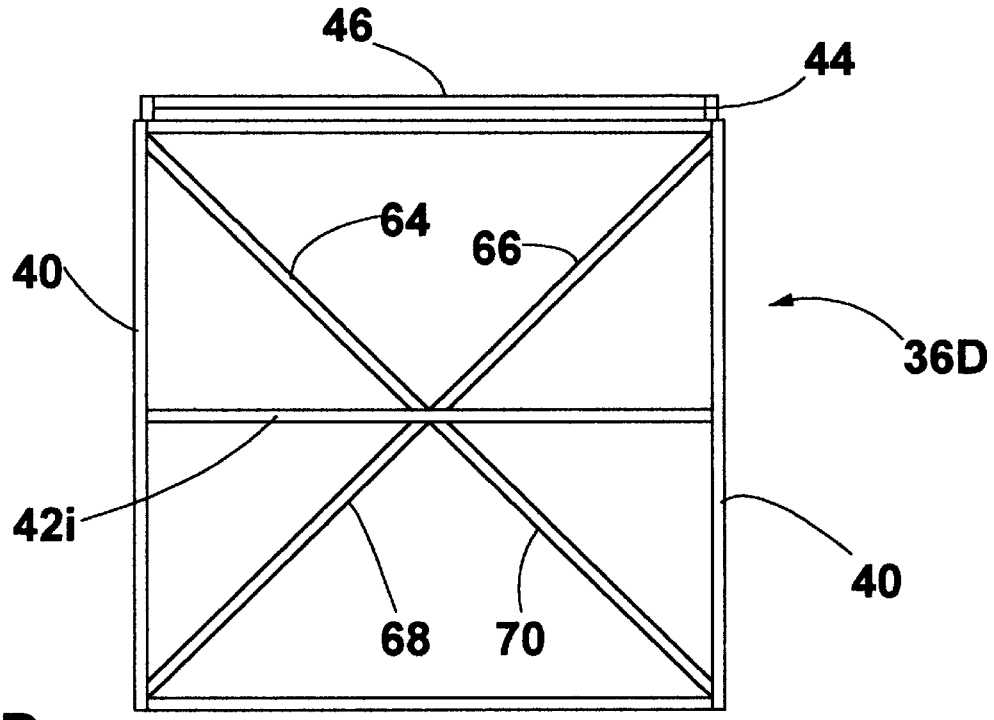
Figure 3E:
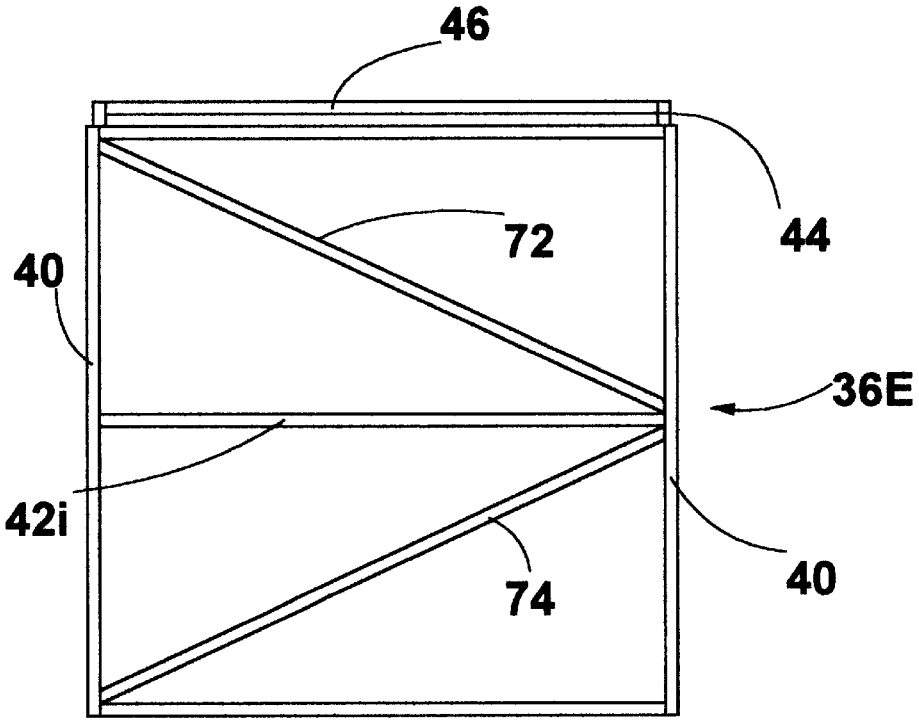
Figure 3F:
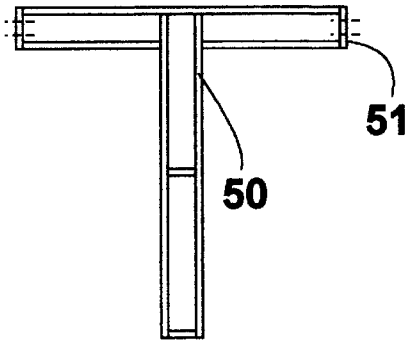
Figure 3H:
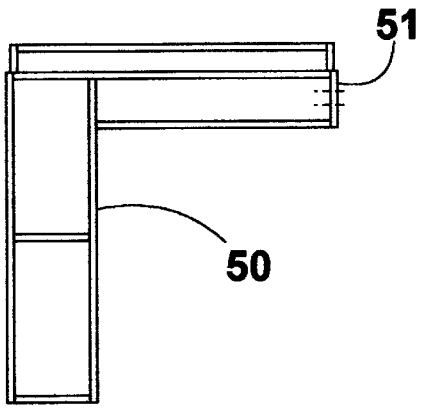
Figure 3G:
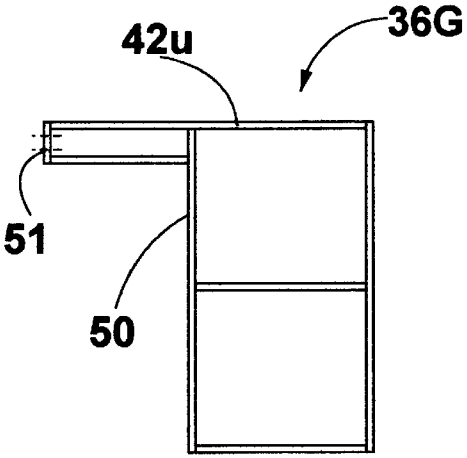
Figure 3K:
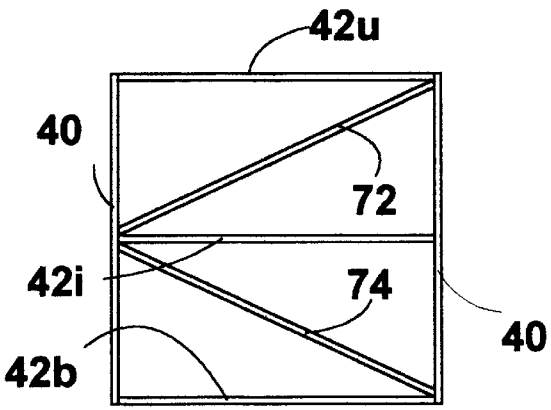
Figure 11:
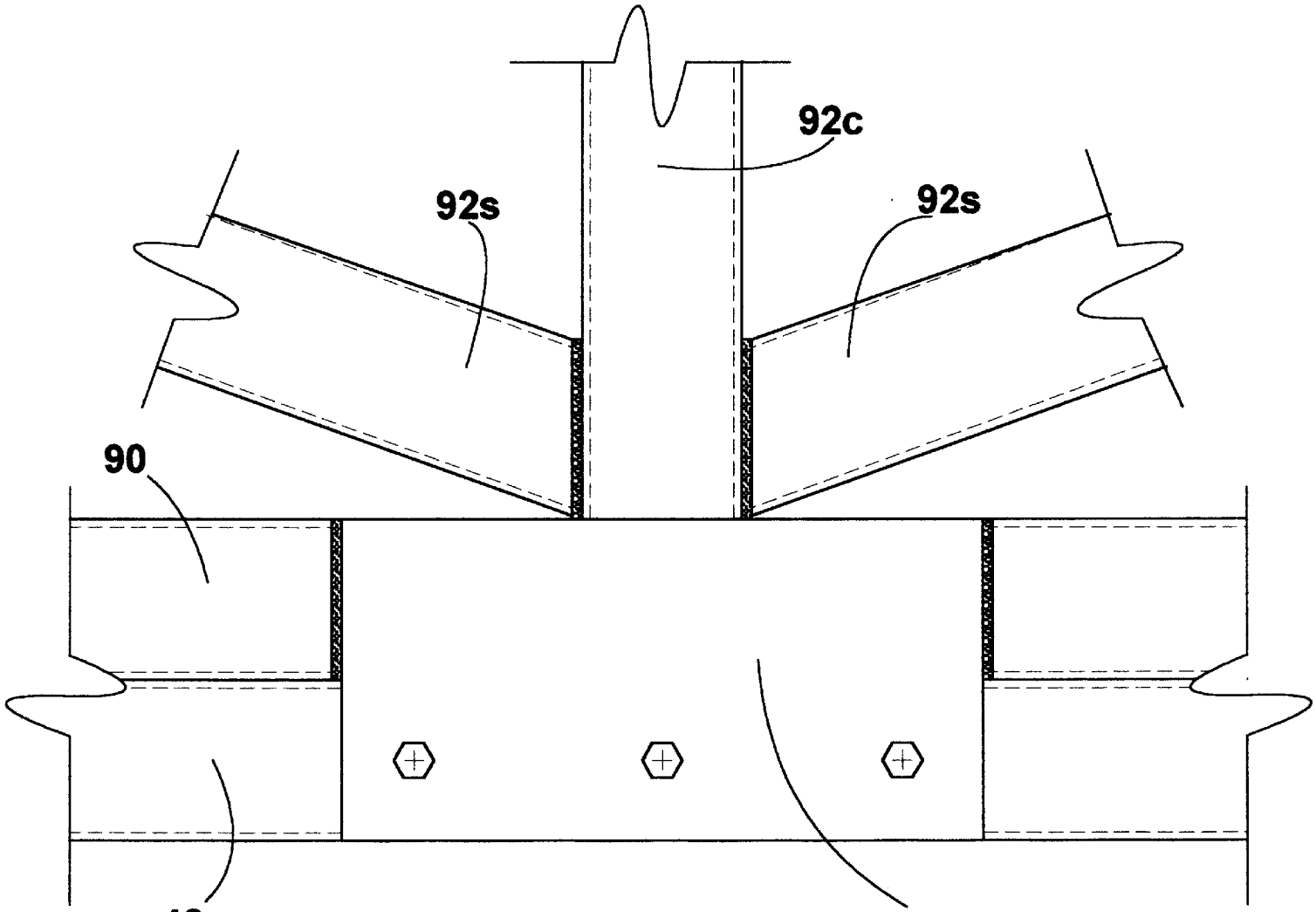
FIG. 11 is an elevation of the center of an end truss at its connection with a supporting end wall frame.

The wall modules for the end wall 22 end are identical to the side wall modules 36 except that the stub members 44 and the eve strut 46 are not used, as shown in FIGS. 3F, 3G and 3K and also in FIGS. 1A and 4, so the upper girt member 42*u* is the topmost structural member on the end wall modules. This enables the lower chord of the end trusses to lie directly atop and be fastened to the upper girt members 42*u* of the end walls 22, as shown in FIGS. 1 and 11 and discussed below.

A door wall module 36B shown in FIG. 3B includes the same upright end members 40 as the wall module 36A, but it has two upright door opening members 50 and 52 welded to the upper longitudinal member 42*u*. The other longitudinal members 42 are welded between the end members 40 and the adjacent door opening member 50 or 52, and a longitudinal door opening member 54 is welded between the upright door opening members 50 and 52 at about the seven foot level as the upper limit of the door opening in the module 36*b*. An eve strut 46 is welded between two upstanding stub members 44 on the top of the upper longitudinal member 42*u*. Three other door opening modules are shown in FIGS. 3F, 3G and 3H. These modules provide upright supports 50 only on one side and are designed to be attached by way of two bolts through an upright stub 51 to an adjacent wall module whose adjacent upright end member 40 provides the other side of the door opening and supports the cantilevered header over the door opening.

Figure 3I:
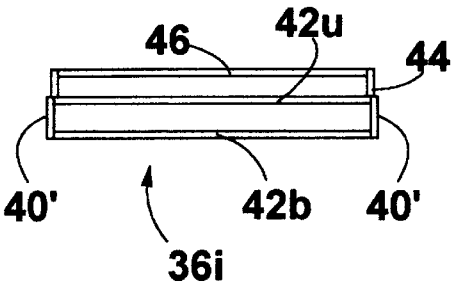
Figure 3J:
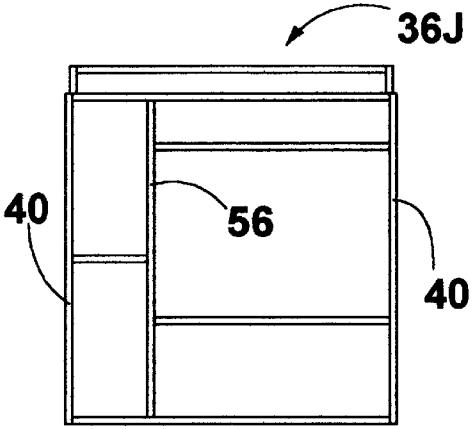

Window wall modules 36C and 36J, shown in FIGS. 3C and 3J, include the same upright end members 40 as the wall modules 36A and 36B. Module 36C has a window opening centered in the module between two upright window opening members 56 and 58 welded between the upper girt member 42*u* and the bottom girt longitudinal member 42*b*. The other intermediate members 42*i* are welded between the upright end members 40 and the two upright window opening members 56 and 58. Top and bottom longitudinal window opening members 60 and 62 are also welded between the two upright window opening members 56 and 58 to outline the window opening. An eve strut 46 is welded between two upstanding stub members 44 on the top of the upper girt member 42*u* on the window wall module 36C. The window opening module 36J has the window opening one one side of the module and has only one upright window opening member 56, using the upright end member 40 as the other upright window opening member.

As shown in FIG. 1A, a diaphragm shear module 36D, shown in detail in FIG. 3D, is added into the peripheral wall 20, preferably on all four sides when extreme diaphragm stiffness is desired, to provide strength and stiffness in the plane of the wall section for resistance against deflection toward a parallelogram shape under wind loads or lateral shaking during an earthquake. Because of the low height-to-width ratio of one and two story buildings that will normally use this invention, shear distortion will predominate over flexural distortion due to bending as a cantilever, so shear bracing is added for resistance to this mode of deflection to minimize not only threats to the safety of the occupants but also to the serviceability of the building after the windstorm or earthquake.

The module 36D includes the same upright end members 40 as the wall modules 36A–36C and a center intermediate girt member 42*i*, but has two upper diagonal brace members 64 and 66 welded between the upper corners of the module and the center of the center intermediate girt member 42*i*. A pair of lower diagonal brace members 68 and 70 are likewise welded between the lower corners of the module 36D and the center of the center intermediate girt member 42*i*. The module 36D is about the same weight as the module 36A but is much stiffer for resisting a lateral force couple in its plane. When bolted into a wall section, the combination of the module 36D with the other modules contributes salutary stiffness to the entire wall section. Deflections in the wall of a building with such high shear strength wall due to lateral wind loads and shaking due to earthquake will be minimal, thereby greatly reducing the structural damage cause to the building by such events.

A second diaphragm shear module 36E, shown in FIG. 3E and shown in FIG. 3K as an end wall module without the eve strut 46, includes the same upright end members 40 as the wall modules 36A 36D and a center intermediate girt member 42*i* like the module 36D, but has only two diagonal brace members, an upper one 72 and a lower one 74. The upper diagonal brace member 72 is welded between an upper corner of the module 36E and a junction between the center intermediate girt member 42*i* and the upright end member 40 on the opposite side from the upper corner. The lower diagonal brace member 74 is welded between the lower corner of the module 36E, on the same side as the upper corner to which the upper diagonal brace 72 is welded, and the underside of the same junction between the center intermediate girt member 42*i* and the upright end member 40 to which the upper diagonal brace 72 is welded. This second diaphragm shear module 36E is lighter and uses less material and fewer welds that the module 36D, but is a bit less strong. The diaphragm shear modules 36D and 36E may be used in combination or separately, depending on the size and desired resistance to wind loads and earthquake effects as specified by the customer.

A header module 36I designed primarily to span openings in the side wall 26 for sliding doors or the like, has two girt members 42*u* and 42*b* separated by two short upright end members 40'. The header 36I shown in FIG. 3I also has an eve strut attached to two inset stub members 44 like the other side wall modules.

Figure 5:
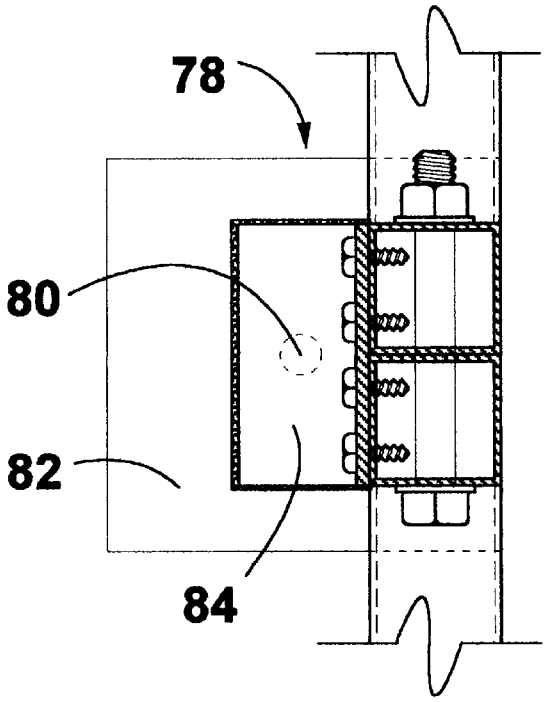
FIG. 5 is plan view of a portion of a peripheral wall at the junction between two adjacent wall modules, showing a connection to one embodiment of a foundation anchor.
Figure 6:
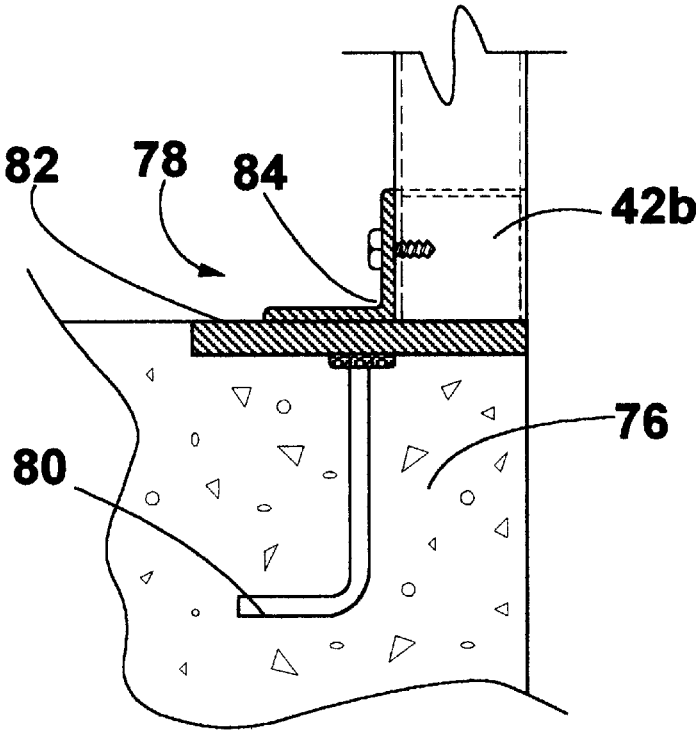
FIG. 6 is a sectional elevation along of the structure shown in FIG. 5 showing a corner foundation anchor attached to two adjacent frame modules.
Figure 20:
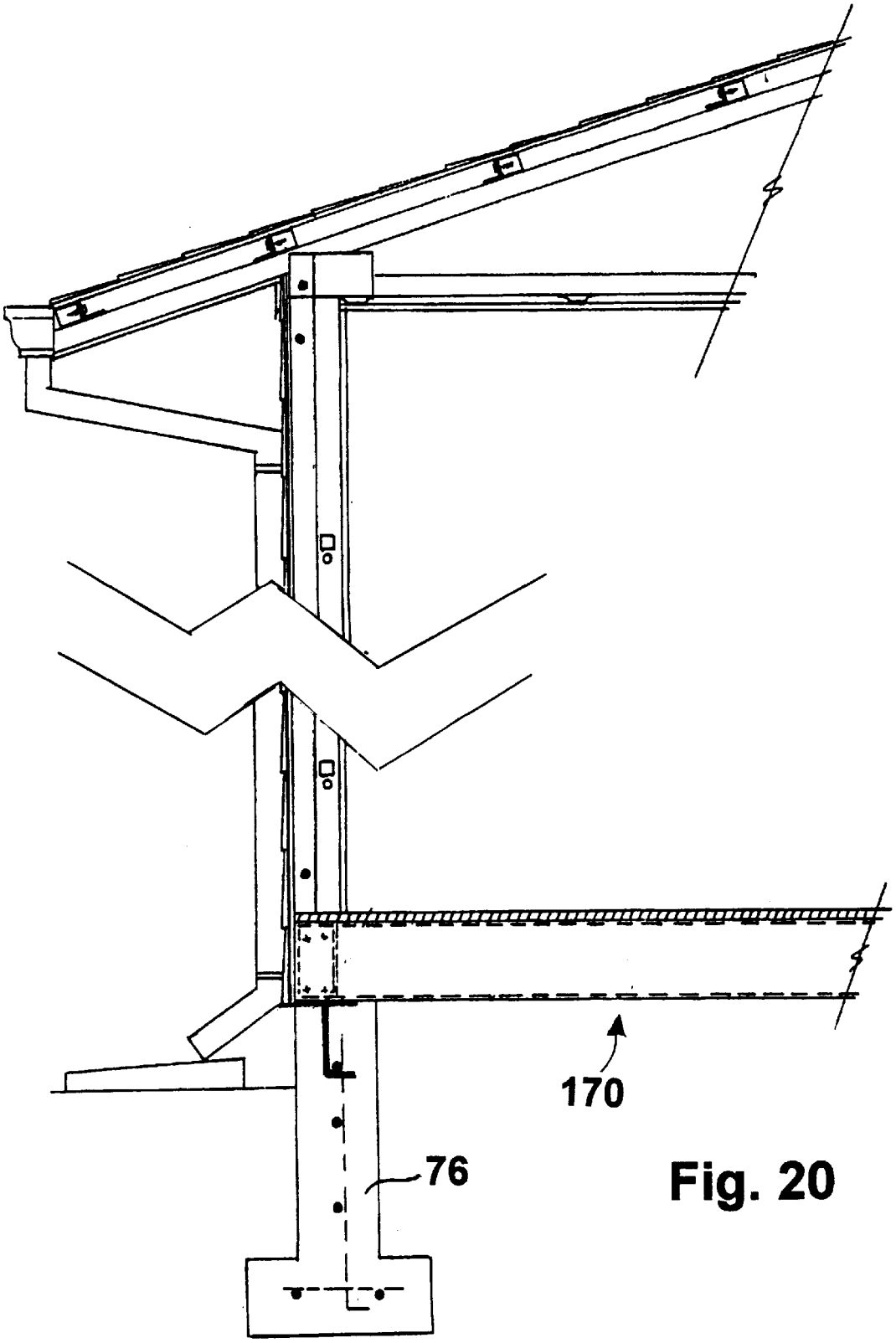
FIG. 20 is a broken sectional elevation end view of a building in accordance with this invention showing the building frame supported on floor joist over a foundation.
Figure 20A:
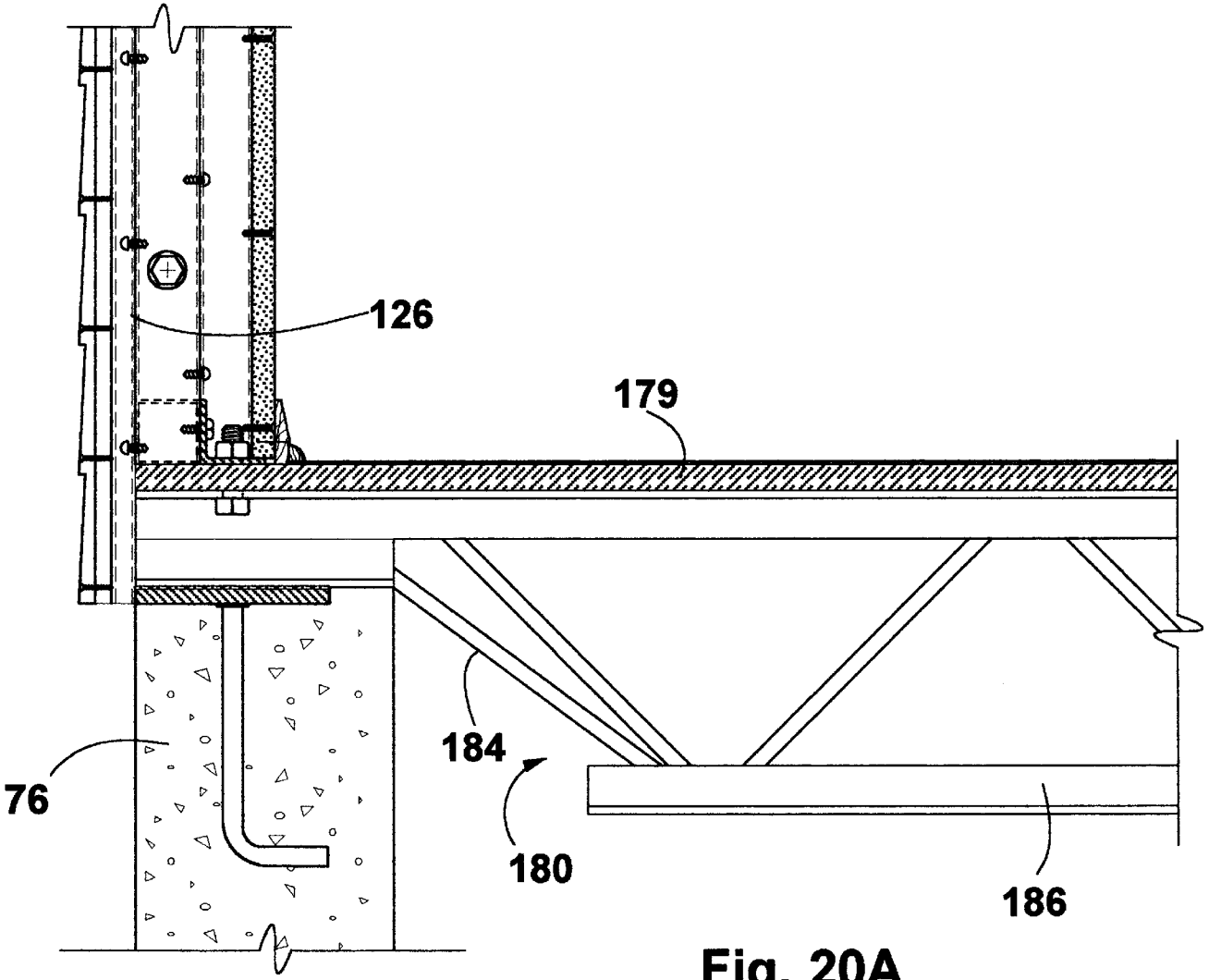
FIG. 20A is a sectional elevation end view of a building in accordance with this invention showing the building frame supported on different type of floor joist over a foundation.
Figure 21:
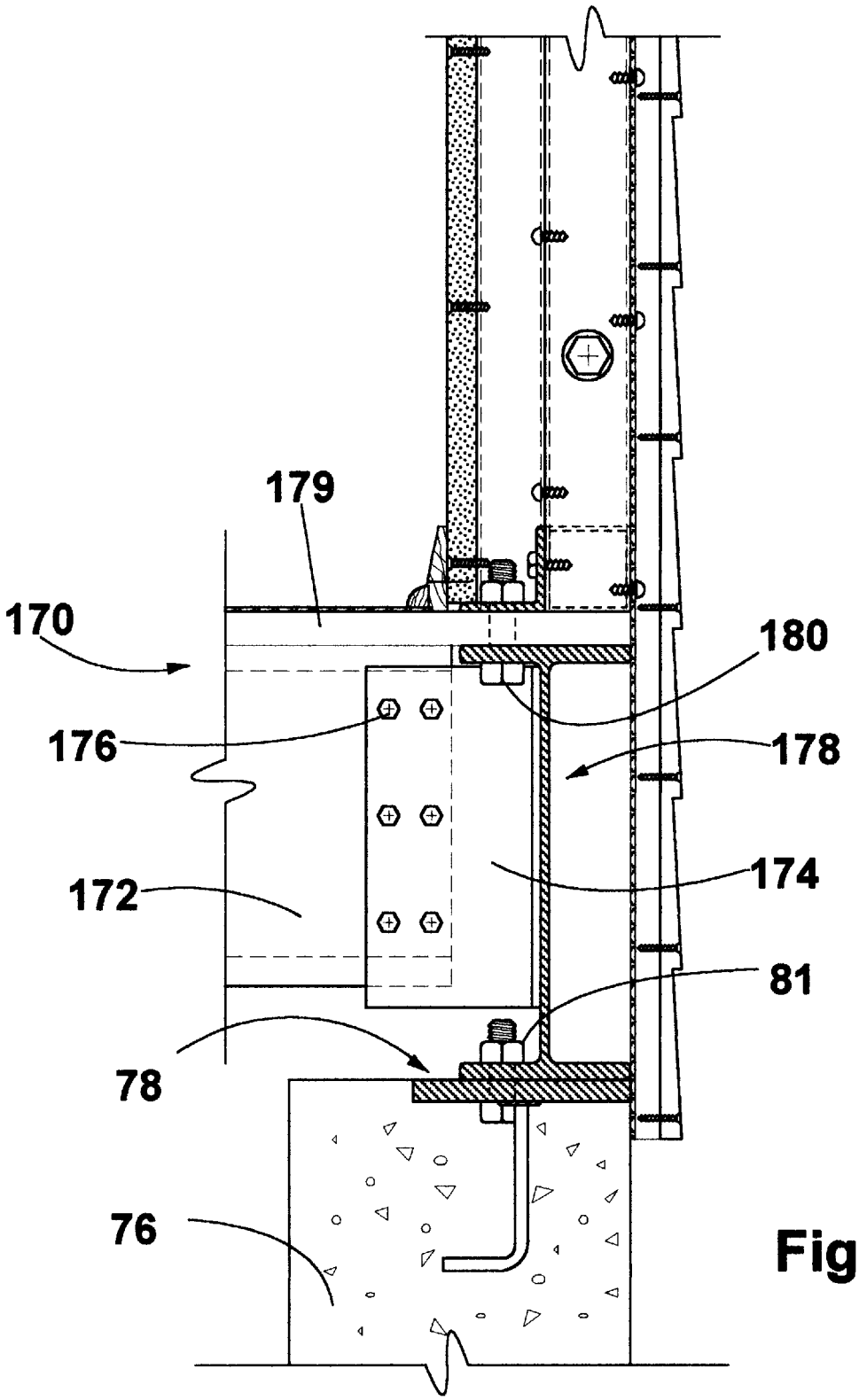
FIG. 21 is an enlarged view of the other end of the joist shown in FIG. 20 supported on the foundation and supporting the building frame.

The wall modules 36 for the house are fabricated in a welding shop and the weld junctions are painted with a galvanizing paint in preparation for transportation to the building site. At the building site, a concrete foundation 76 is poured and anchors 78 are embedded in the concrete before it cures so that, on curing, the side anchors 78 are permanently fixed in the foundation. The foundation could be a perimeter footing around a slab, or it could be a basement perimeter wall as shown in FIGS. 20, 20A, and 21, depending on the house design. It could also be piers, pillars or grade beams or numerous other known foundation designs. The embedded anchors 78, one of which is shown in FIGS. 5 and 6, each include a J-bolt 80 and a top plate 82 welded to the top of the J-bolt 80. The top plate 82 has a central hole about the same diameter as the J-bolt diameter and receives the J-bolt into the hole for welding to the top and bottom of the plate 82. Alternatively, the J-bolt could be welded directly to the underside of the plate 82. A right angle bracket 84 is welded to the top plate 82 for attachment of the lower longitudinal members 42*b* or the bottom ends of the upright end members 40 of the frame modules 36 where they are connected to each other, as shown in FIG. 5. The bracket 84 is wide enough to span the entire width of the abutting upright end members 40 as shown in FIG. 5.

The anchors 78 are placed in the foundation 76 at positions corresponding to the junctions between adjacent wall modules 36 and the brackets 84 welded to the plate 82 at a position spaced back from the foundation edge a distance equal to the width of the module tubing, or 2" from the outer edge of the top plate 82 so that the outside surface of the lower longitudinal members 42*b* lies flush with the outer edge of the foundation to facilitate the attachment of insulation and exterior siding overlapping the frame and foundation without an unsightly or condensation-collecting step at the interface of the frame and the foundation.

Figure 7:
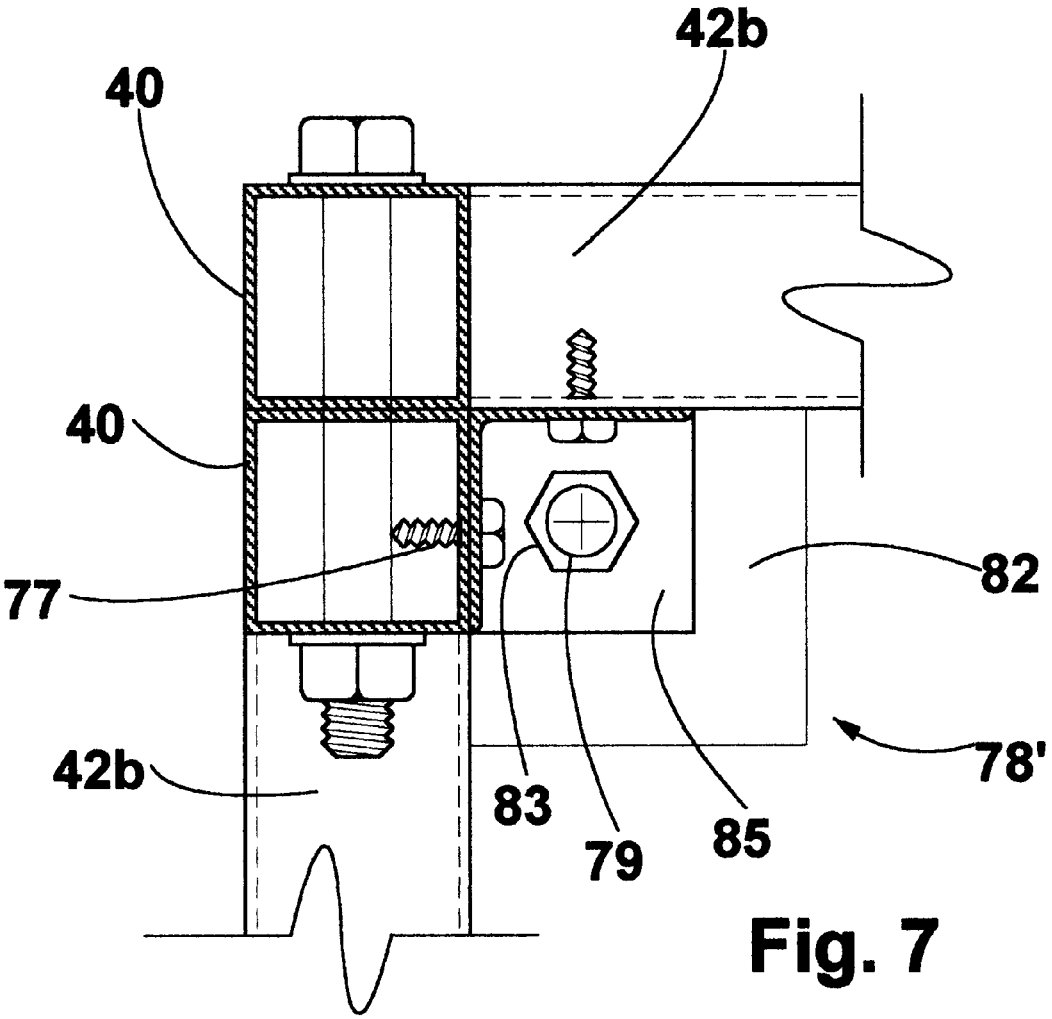
FIG. 7 is a sectional plan view of a corner section of the building frame shown in FIG. 1, showing the attachment to a corner foundation anchor.
Figure 8:
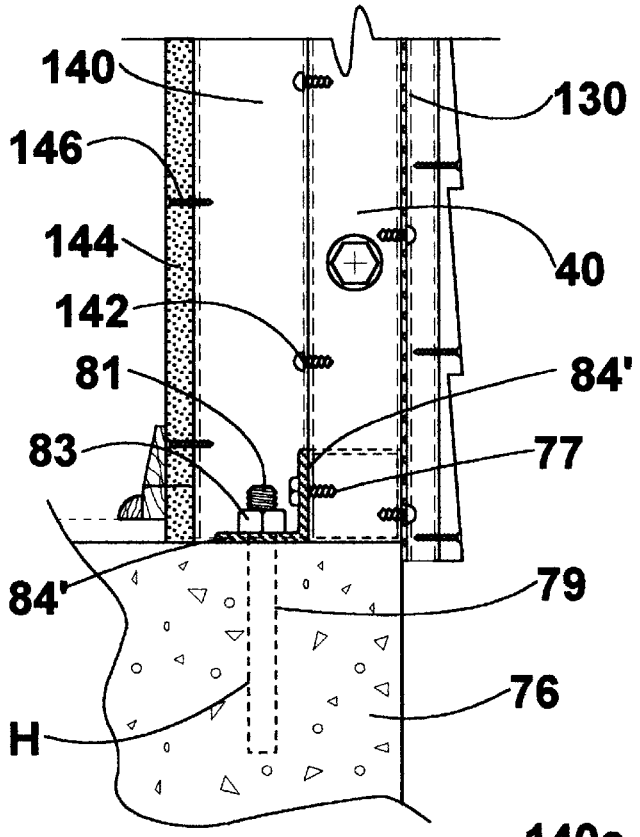
FIG. 8 is a sectional elevation of the wall of a house built in accordance with this invention showing the building frame attached to an alternate embodiment of a foundation anchor.
Figure 9A:
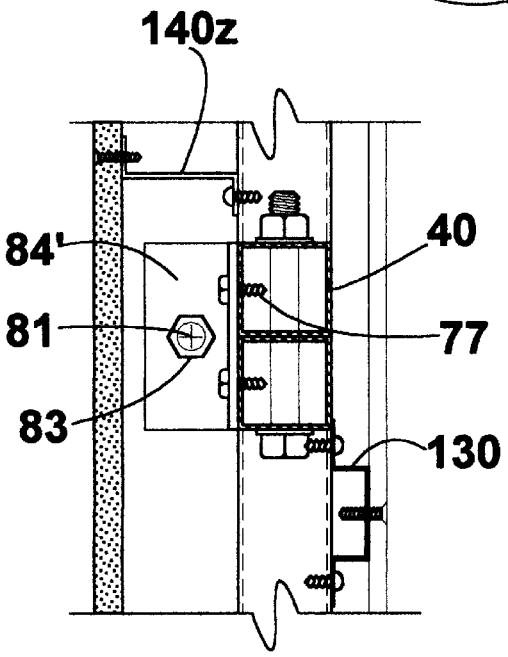
FIGS. 9A and 9B are sectional plan views of the structure shown in FIG. 8, showing Z-shaped and channel (C) shaped studs, respectively.
Figure 9B:
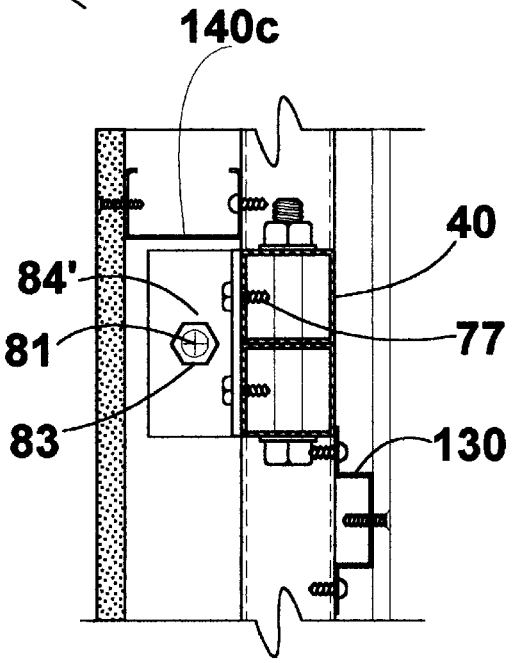

A corner anchor 78', shown in FIG. 7, is placed at each corner of the foundation 76 in line with the side anchors 78. The corner anchor 78' is identical to the side anchors 78 with the single exception that the bracket 85 for connecting the anchor to the frame modules 36 at the corner of the peripheral wall 20 has two upstanding flanges 87 lying at right angles to each other and welded together along their adjacent edges. The two upstanding flanges 87 are fastened to the wall modules 36 at the corner after the wall modules are connected together, as explained below. Alternatively, the corner anchor 78' may be attached to the foundation using a threaded rod 79 that is set into a hole H drilled into the foundation and secured therein with epoxy. A nut 83 is tightened onto the threaded rod 79 after the epoxy has set to hold the anchor plate 82 down against the top of the foundation. This type of threaded rod 79 can also be used on the side anchors, as shown in FIGS. 8, 9A and 9B, embedded in the foundation 76, but has a free upper end 81 that is threaded for threadedly receiving the nut 83. A bracket 84' has a central hole that fits over the threaded end 81 of the J-bolt 79 and is held down against the top surface of the foundation 76 by the nut 83. The bottom longitudinal members 42*b* or lower end of the upright end members 40 are fastened to the bracket 84' by screws 77 in the same manner as for the anchor shown in FIGS. 5–7.

The trusses 30 shown in FIGS. 1, 1A, 2 and 10, are constructed of an upper chord 88 made of two pitched tubular steel members, described above, lying at an angle of 20° or more to a lower chord 90 to which they are welded.

A plurality of internal brace members 92 are welded between the upper chord 88 and the lower chord 90. The trusses may be Pratt trusses in which half of the internal members 92*v* between the upper and lower chords are vertical and in compression, and the other half 92*s* are sloping and in tension. The connection between the upper chord 88 and the lower chord 90 in each truss 30 includes a connector plate 94 welded to both sides of the truss 30. The connector plate may be sized for the size of the truss, but is typically about 4"×8" and about ⅛" thick. The width of the pocket 48 between the upright stub members 44 is made wide enough to accommodate the connector plates 94 on each side of the truss, as shown in FIG. 4A. An apex connector plate 96 is welded on each side of the truss at the apex of the two pitched halves 88 where they are welded together and to the center vertical internal member 92*c*.

After the wall modules 36 and trusses 30 have been fabricated in the shop and the foundation has cured with the anchors 78 and 78' in place, the wall modules and trusses are trucked to the building site and unloaded around the foundation at about the positions they will occupy on the foundation. The modules 36 can be tipped up with a small crew and bolted together with bolts 106 extending through aligned holes in the upright end members 40 at the top and bottom adjacent the upper and lower longitudinal members 42*u* and 42*b*, with an additional bolt 106 at about the mid-level height of the end members 40. Advantageously, the corner modules are fastened together first, and then the intermediate modules are then added and secured with bolts 106. When all the wall modules have been erected and connected together, the bolts 106 are tightened, starting with one of the corners fastened with the right angle flange 86 shown in FIG. 7 and working around the peripheral wall 20 in both directions toward the opposite corner. The holes for the bolts in the upright end members 40 of the wall modules 36 are preferably predrilled in the shop but may also be drilled at the building site by aligning and clamping the frame modules 36 together and then drilling the bolt holes through the clamped upright end members 40 of the adjacent modules 36. Finally, the moduless are all fastened to the anchorflanges 84 and 87, as shown in FIGS. 5–7.

When all the wall modules have been bolted together to complete the peripheral wall 20, the trusses 30 are lifted onto the top of the peripheral wall 20 for attachment thereto. The end trusses are attached first by laying the bottom chord 90 atop the upper longitudinal member 42*u* of the end walls 22 and 24 and fastening the depending portion of a connector plate 103 welded to the center and several other spaced locations on the lower chord 90 to the upper longitudinal member 42*u*. The other trusses between the end trusses are fitted into the pockets 48 between the upstanding stub members between adjacent side wall modules 36 where they are supported without bracing until they are bolted into place.

A hole is drilled in the shop through the upstanding stub members 44 and preferably also through the lower chord 90 of the trusses 30, and a bolt 107 is inserted through the holes to secure the trusses to the peripheral wall 20. Alternatively, the upright stub members 44 could be predrilled and the truss lower chord 90 back drilled when it is in place to avoid the possibility of slight misalignment of the holes when the parts come together. The bolting of the trusses into the pockets 48 through the upright stub members 44 secures the roof to the peripheral wall 20 and, together with the anchoring of the peripheral wall 20 to the foundation, anchors the roof to the foundation against displacement due to wind loads or differential movement of the foundation and the building during an earthquake. The bolt 107 is tightened to exert a strong frictional force between the stub members 44 and the truss so the hold-down force on the roof does not depend on the shear resistance of the bolt 107.

The end trusses have no pockets to fit into, but they do fit into notches created by the offset of the upright stub members 44 on the side wall modules 36 to which they are bolted. To provide additional strength and rigidity of the connection of the end trusses to the end walls 22 and 24, connector plates 103, shown in FIG. 11, are welded to the lower chord 90 of the truss at its center point and at the two or more positions along the length of the lower chord 90, and at its ends. The connector plates 103 each have a portion depending downward from the truss and lying alongside the upper girt member 42*u* of the modules on the end walls 22 and 24. The depending portion of the connector plates 103 are fastened by self-drilling, self-tapping screws or the like to the outside surface of the modules in the end walls 22 and 24 to provide resistance to overturning forces while the trusses are being erected.

As shown in FIGS. 12–15, diagonal bracing may be provided in the horizontal plane at the top of the wall modules between the trusses for increased stiffness against wind loads. As shown most clearly in FIG. 13, cross braces 108 are connected from the junctions of the trusses 30 and side walls 26 and 28 to the center of the adjacent trusses. The connection of the diagonal braces 108 to the ends of the trusses 30, shown in FIG. 14, includes a connector plate 110 welded to the underside of the lower chord 90 of the trusses 30 adjacent to their connection the side walls 26 and 28. An L-shaped bracket 112 is welded to each end of the cross braces 108 and is attached to the connector plate 110 by bolts 114. The other ends of the diagonal braces 108 are attached to center connector plates 115 welded to the underside of the lower chords 90 of the trusses 30 at the midpoint of their length. The diagonal braces are attached by means of bolts 114 to brackets 112 welded to the ends of the braces 108. A stiffening gusset 116 may be welded between the connector plate 115 and the center vertical brace 92*c*.

Figure 12:
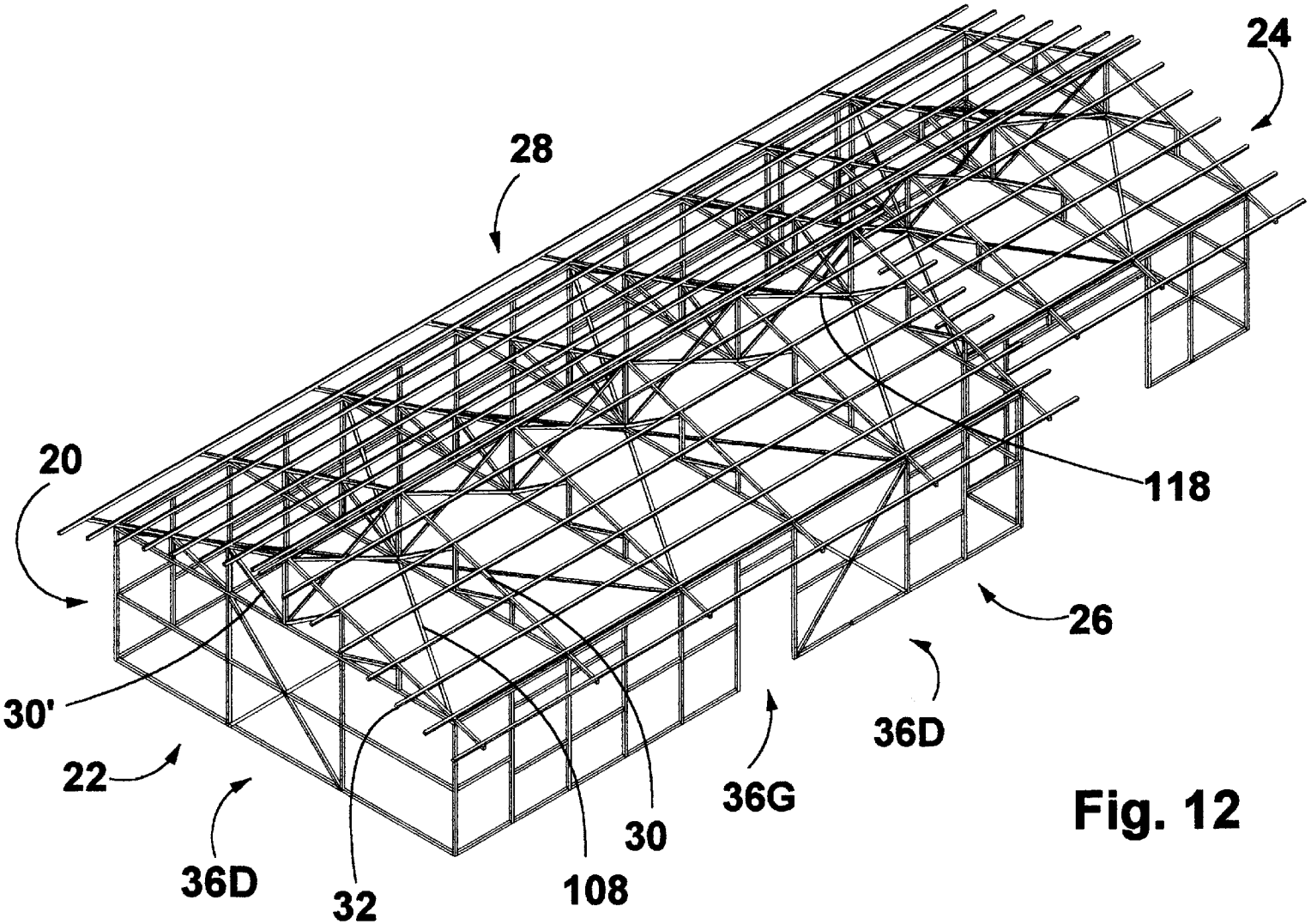
FIG. 12 is a schematic perspective view of a building frame made in accordance with this invention with diagonal bracing between the trusses in both horizontal and vertical planes.
Figure 13:
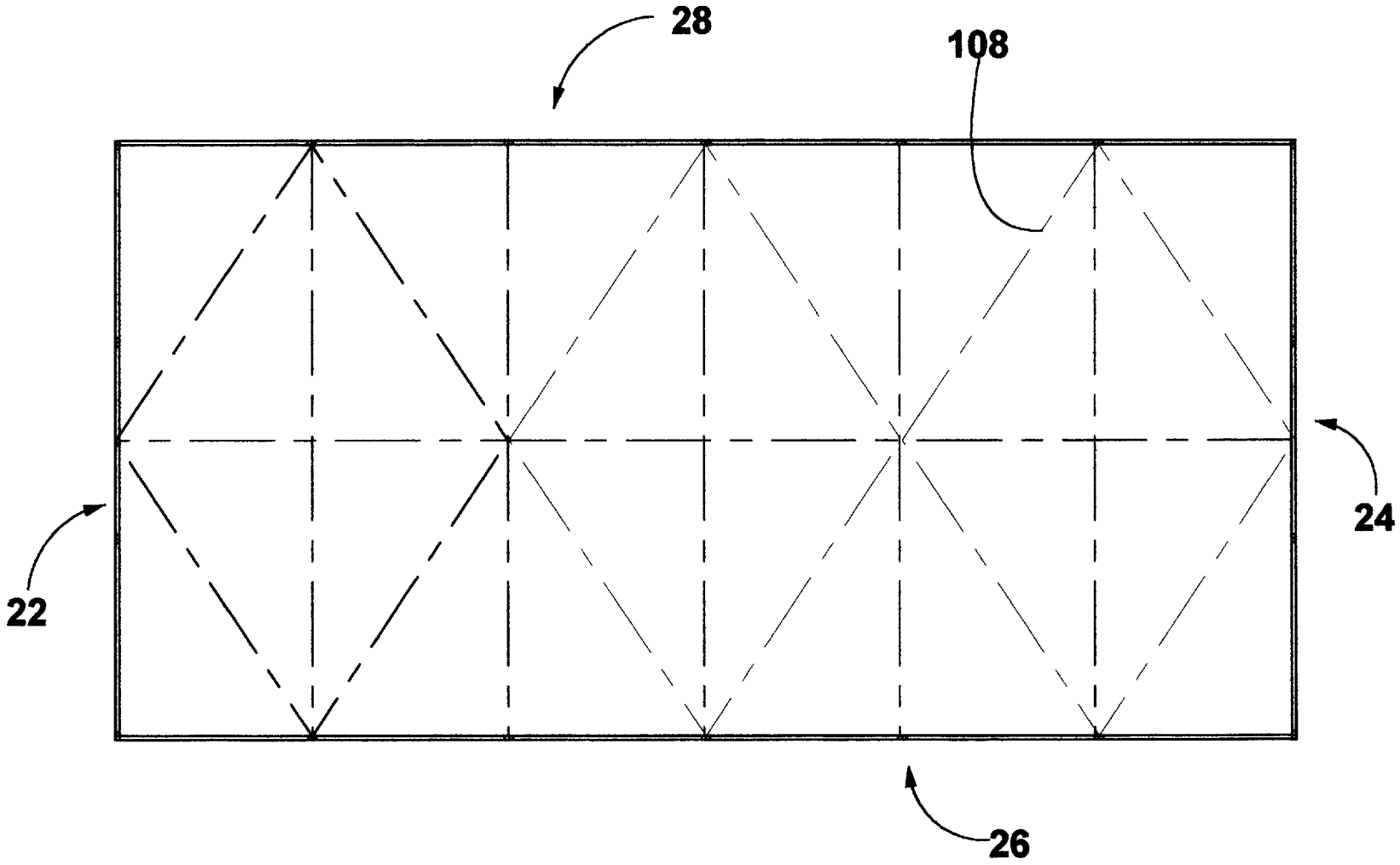
FIG. 13 is a schematic plan view of a building made in accordance with this invention with cross bracing between the lower chords of the trusses, as indicated in FIG. 12.
Figure 14:
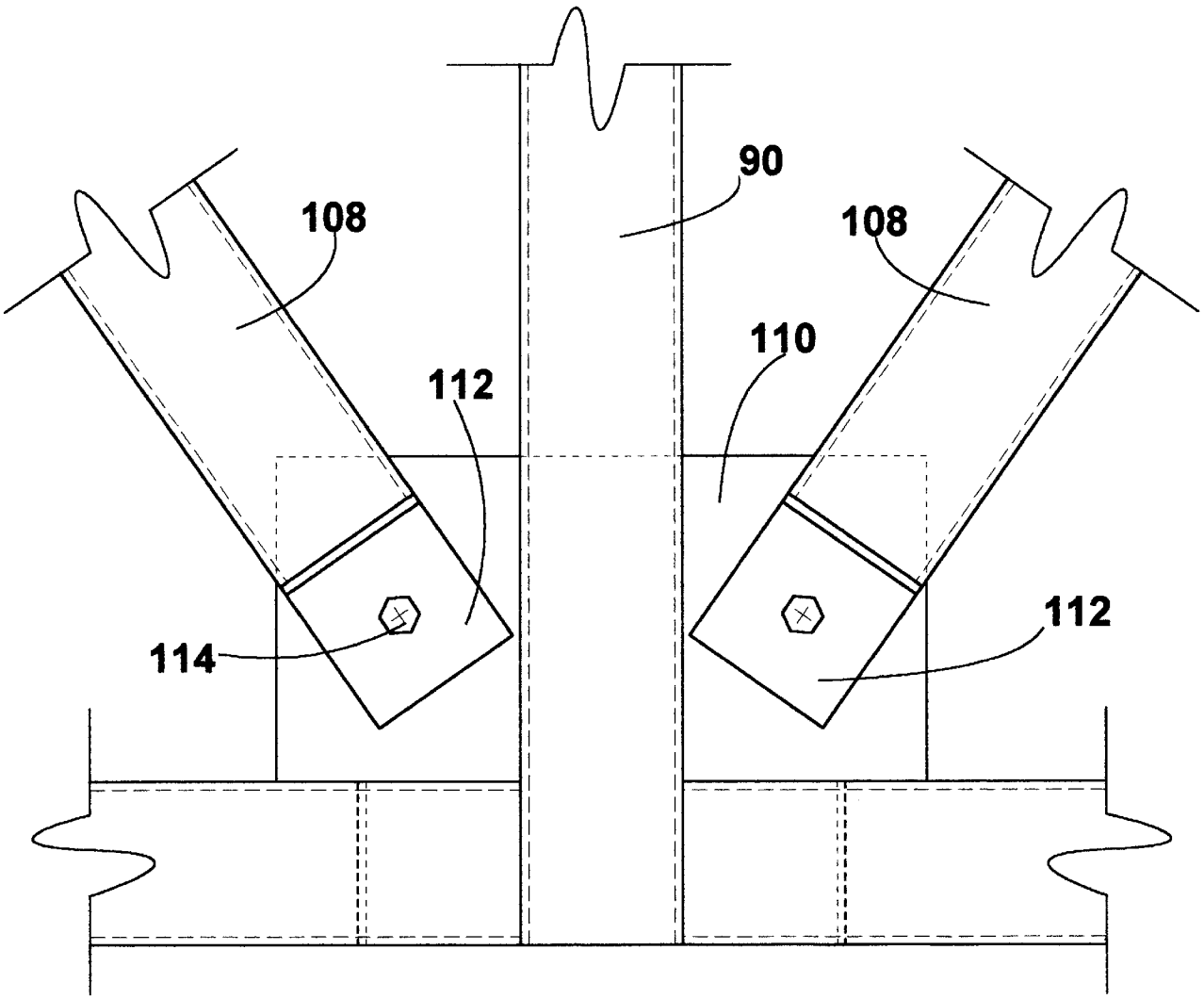
FIG. 14 is a plan view of a connection for cross bracing at the ends of the trusses.
Figure 15:
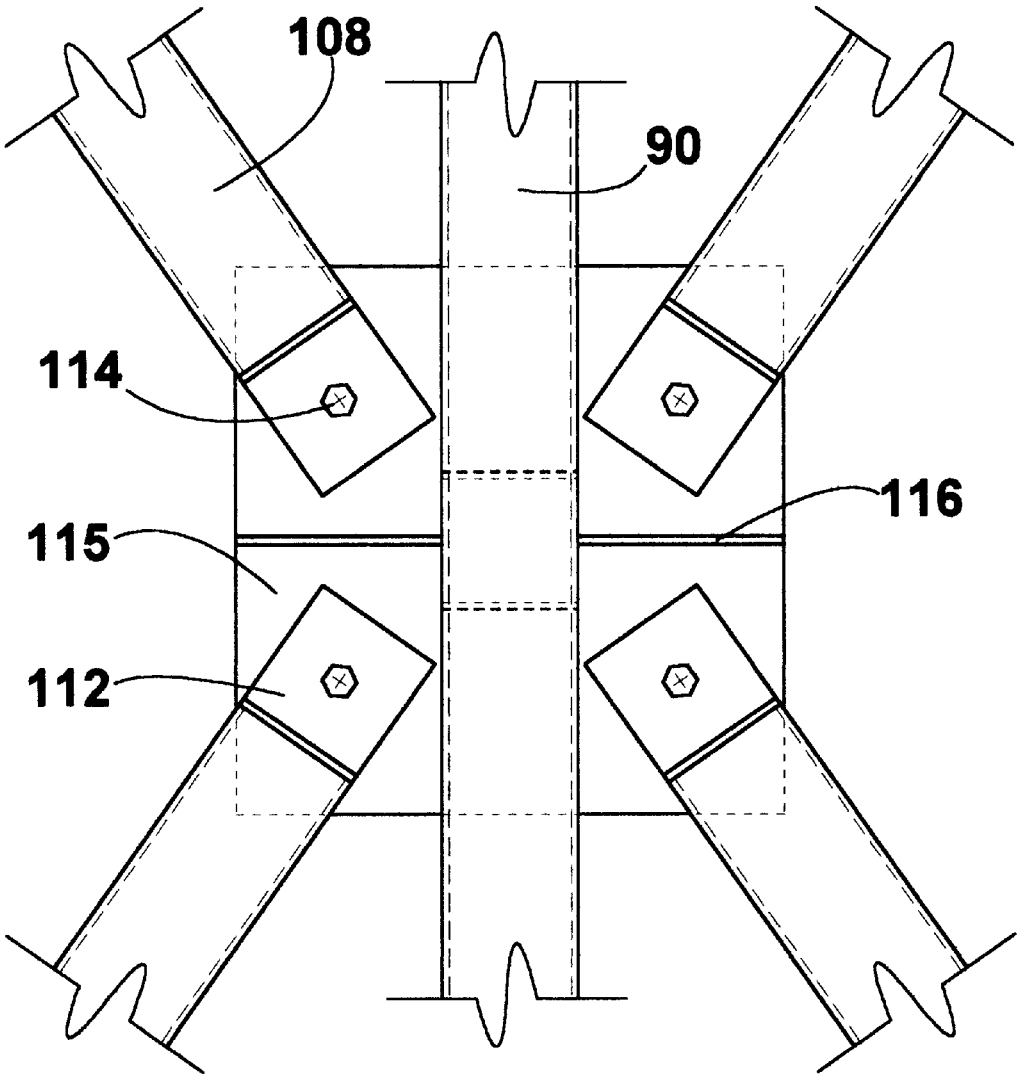
FIG. 15 is a plan view of a connection for cross bracing at the center of the trusses.
Figure 16:
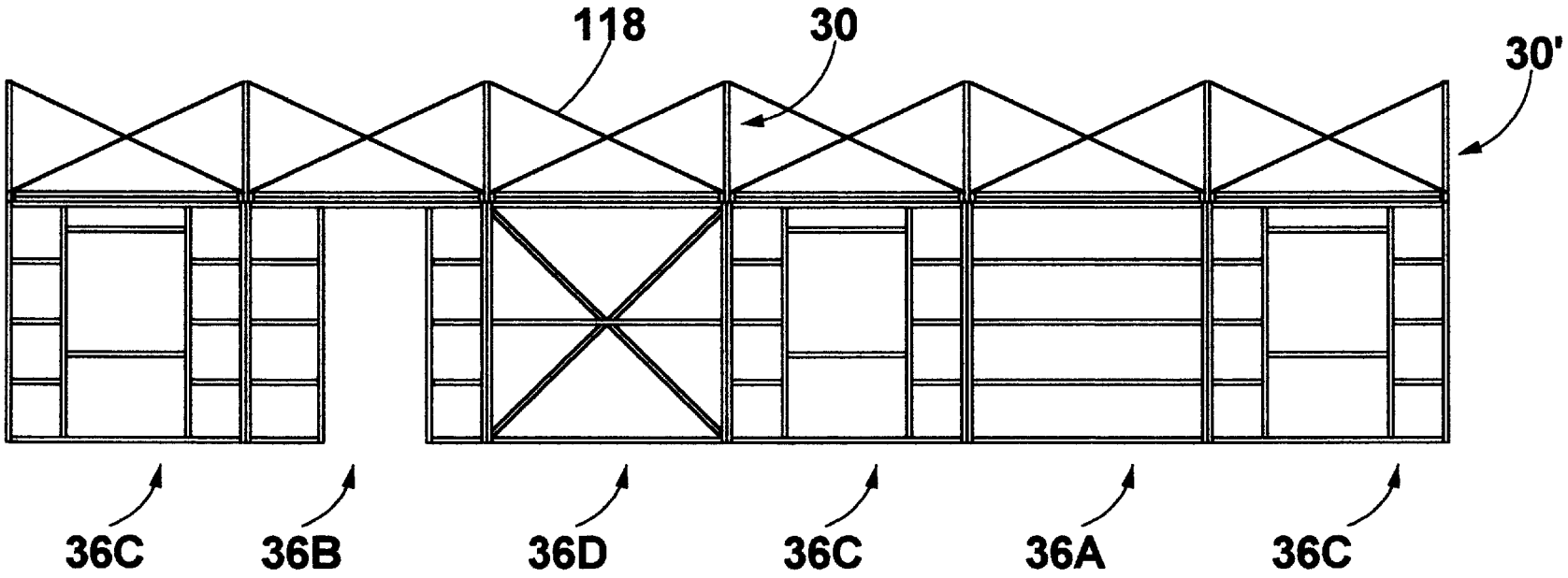
FIG. 16 is a schematic elevation of a building frame according to this invention, showing diagonal bracing in the vertical plane for the trusses.

Diagonal cross bracing in a vertical plane for the trusses 30 may be provided as shown in FIGS. 12 and 16 to give lateral support for the trusses against racking wind loads. The bracing includes braces 118 connected between the apex of the upper chord 88 on each truss 30 to the center of the lower chord 90 on each adjacent truss. The braces 118 are connected at each end to connector plates by bolts, and are bolted together where they cross each other at 120 to improve resistance against the tendency to buckle under compressive load.

Figure 17:
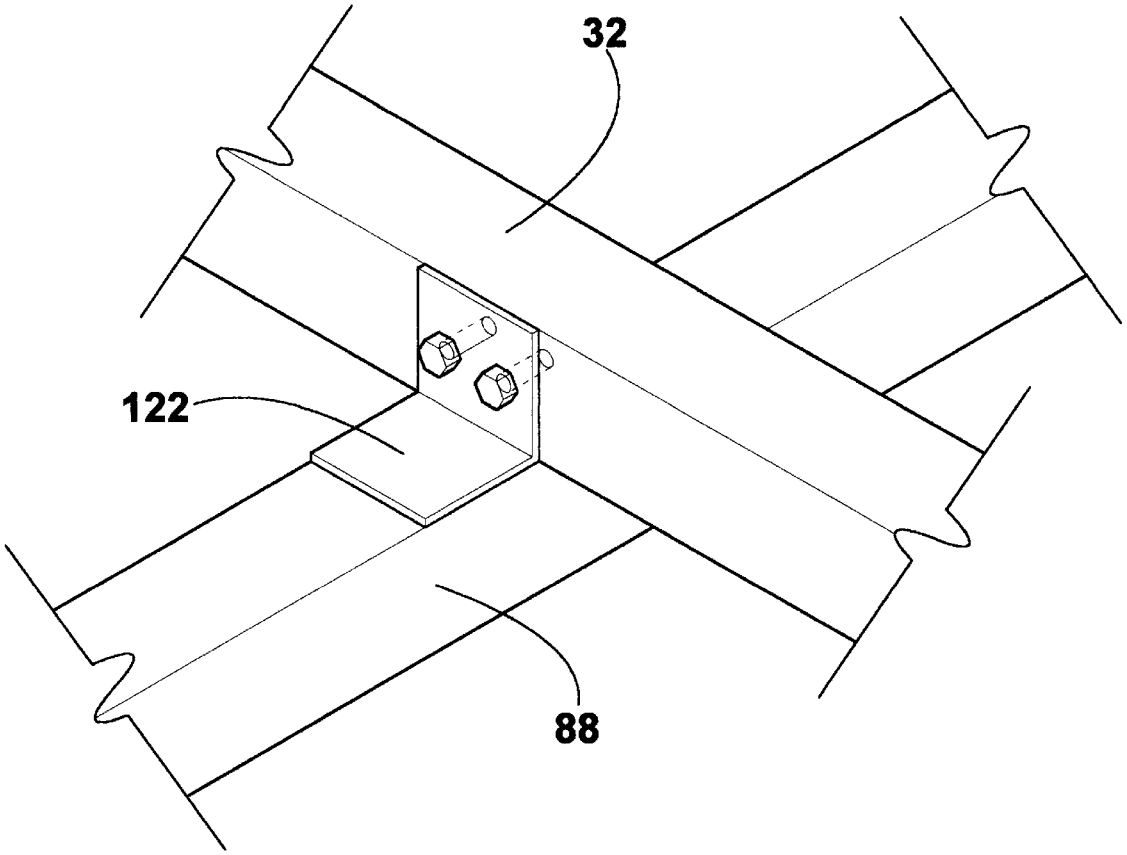
FIG. 17 is a perspective view of an upper chord of a truss shown supporting a purlin, and showing a connector clip for attaching the purlin to the truss.

After all the trusses 30 have been lifted into place and bolted into the pockets 48, the longitudinally extending purlins 32 are fastened to brackets 122 prewelded onto the upper chord 94 of the trusses, as shown in FIG. 17. The purlins 32 lie atop the trusses 30 and connect them together. Roof sheathing 124 is laid over and screwed to the purlins, as shown in FIG. 2, and the roof is sealed and shingled in the usual manner.

As shown in FIGS. 2, 8, 18 and 19, a vapor barrier and insulating material 126, such as the material sold commercially as Astrofoil, is taped around its edges to the wall modules 36 and is clamped in place by a series of vertically extending hat channels 130 which are attached by self-drilling screws 128 or the like to the exterior surface of the peripheral wall 20 over the insulation 126 to the outside surface of the peripheral wall 20 for attachment of exterior siding 132.

Vertically extending metal studs 140 are fastened to the wall modules 36 at regular spacing therealong, e.g. every 2 feet. The studs are fastened by self-drilling screws 142 or the like, and provide an inside surface on a plane to which interior wallboard 144 can be connected by self-drilling wallboard screws 146. Before fastening the wallboard 144, fiberglass insulation or rigid board insulation is installed in the space between the inside surface of the insulation material 126 and the plane defined by the inside surface of the metal studs 140 to which the wall board 144 is attached. The attachment of the metal studs 140 stiffens the wall modules 36 and also provides damping by the friction between the studs 140 and the modules 36 in the event of an earthquake to dampen the oscillation of the stiff metal frame structure provided by the bolted unitary peripheral wall and truss structure. Two different types of studs 140 are shown in FIGS. 9A and 9B. In FIG. 9A, Z-studs are shown which are very easy to attach to the frame modules 36 because of the off-set flange. In FIG. 9B, C-studs are shown which are actually preferred because they are stiffer and less expensive.

Figure 10:
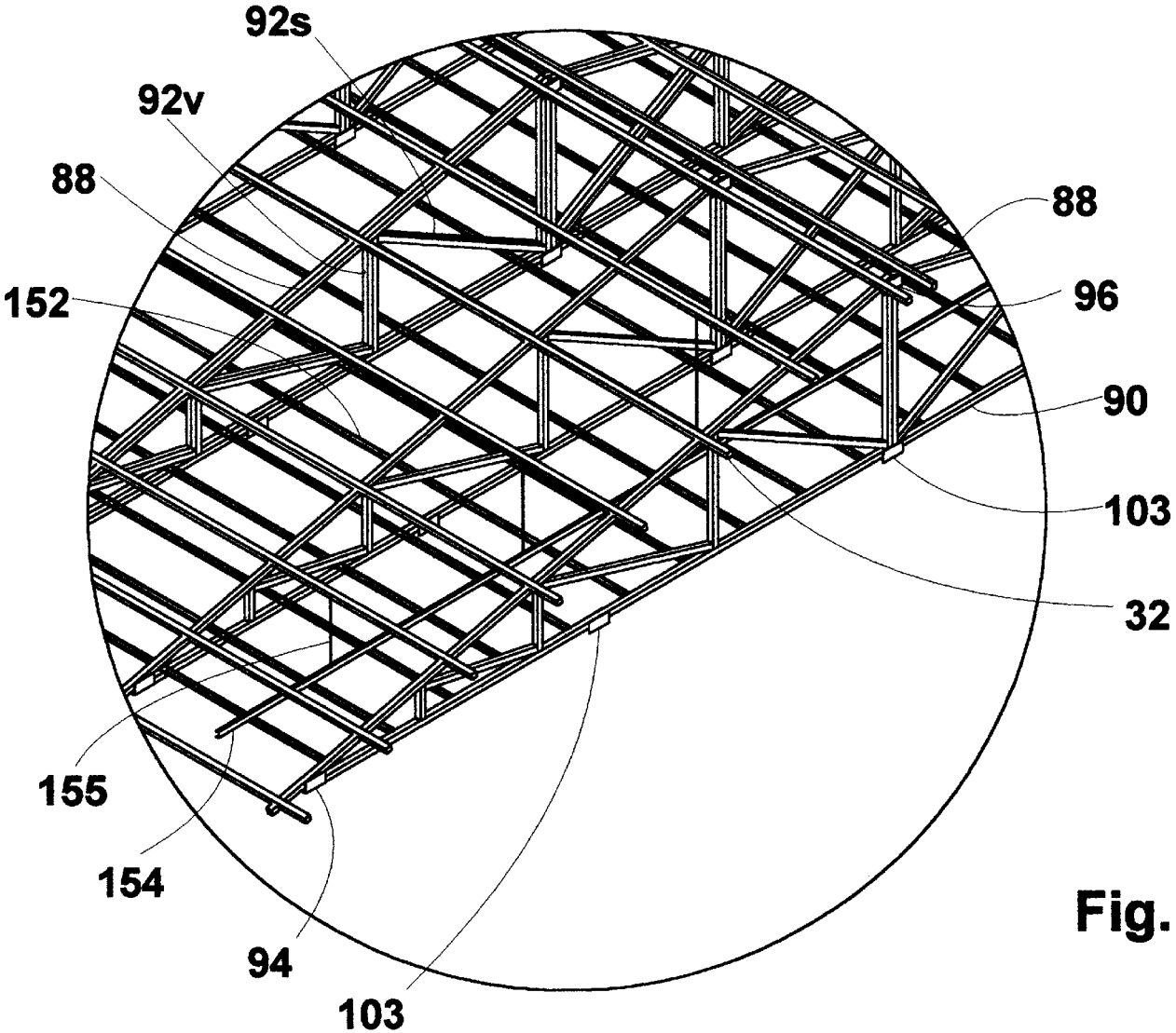
FIG. 10 is a perspective view of a truss for supporting a roof in buildings made in accordance with this invention.

As shown in FIGS. 2 and 10, ceiling wallboard 150 is attached to hat-channels 152 connected to the underside of the lower chord 90 of the trusses 30 and to a series of C-channels 154 hung by wire 155 from the purlins 32 at the same level as the lower chords 90 of the trusses 30, as shown in FIG. 10.

Figure 18:
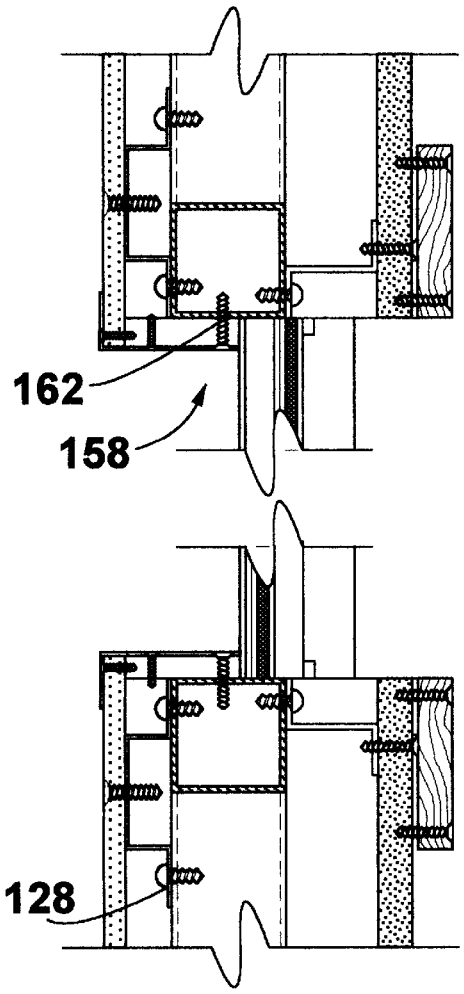
FIGS. 18 and 19 are sectional plan views showing the connection of conventional door and window units in a building frame of this invention.
Figure 19:
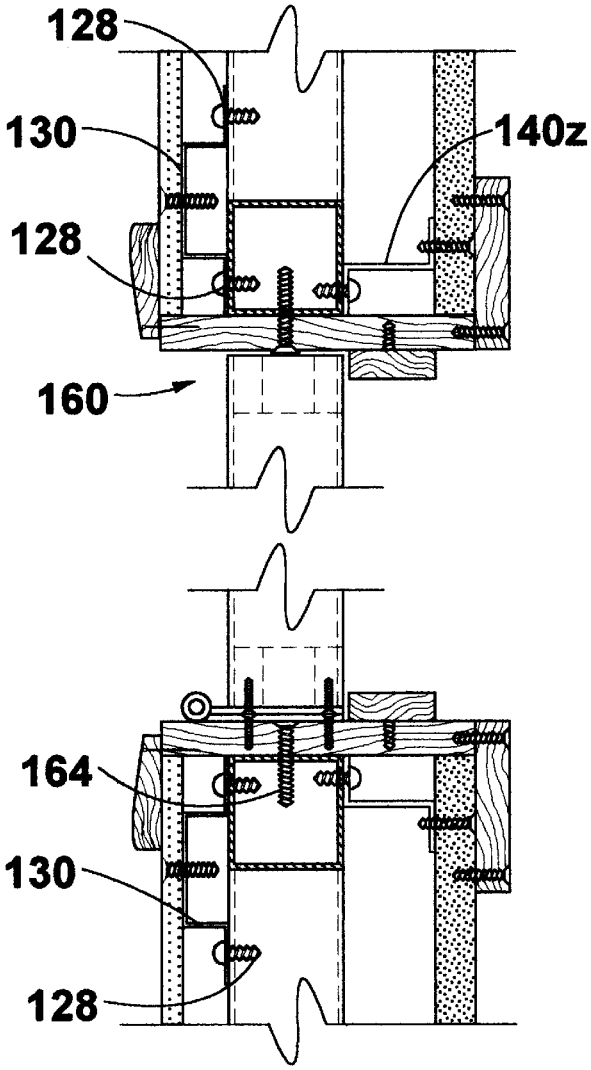

FIGS. 18 and 19 illustrate how conventional window units 158 and door units 160 fit into walls constructed in accordance with this invention. The proportions of the dimensions of these units to the overall thickness of the wall is the same as it is for conventional wood frame construction, so the appearance of houses built with metal frame modules as described is the same as conventional houses. The standard prefabricated window and door units attach directly into the window and door openings exactly, without shimming, because the openings are fabricated with exact 90° inside corners and are accurately sized to receive the window and door units with a snug sliding fit. The units are attached with self-drilling, self-tapping screws 162 and 164 directly into the window and door opening members, and suitable trim is applied as shown to complete the installation.

Figure 23:
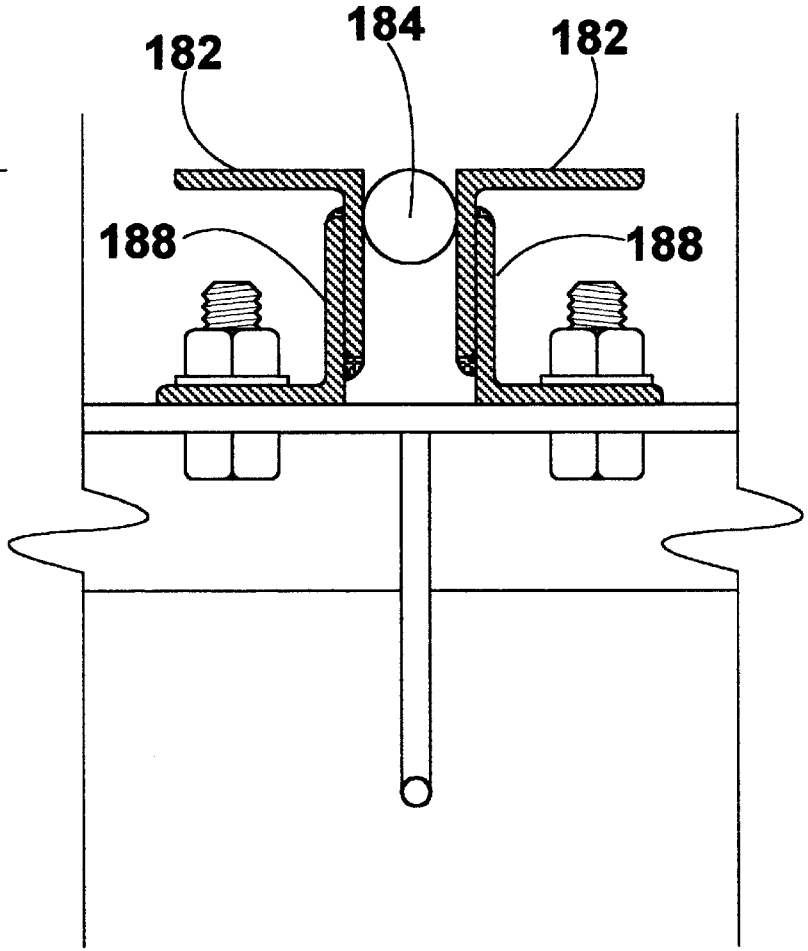
FIGS. 22 and 23 are enlarged sectional side and end views of the end portion of the joist shown in FIG. 20A and its attachment to the foundation.
Figure 22:
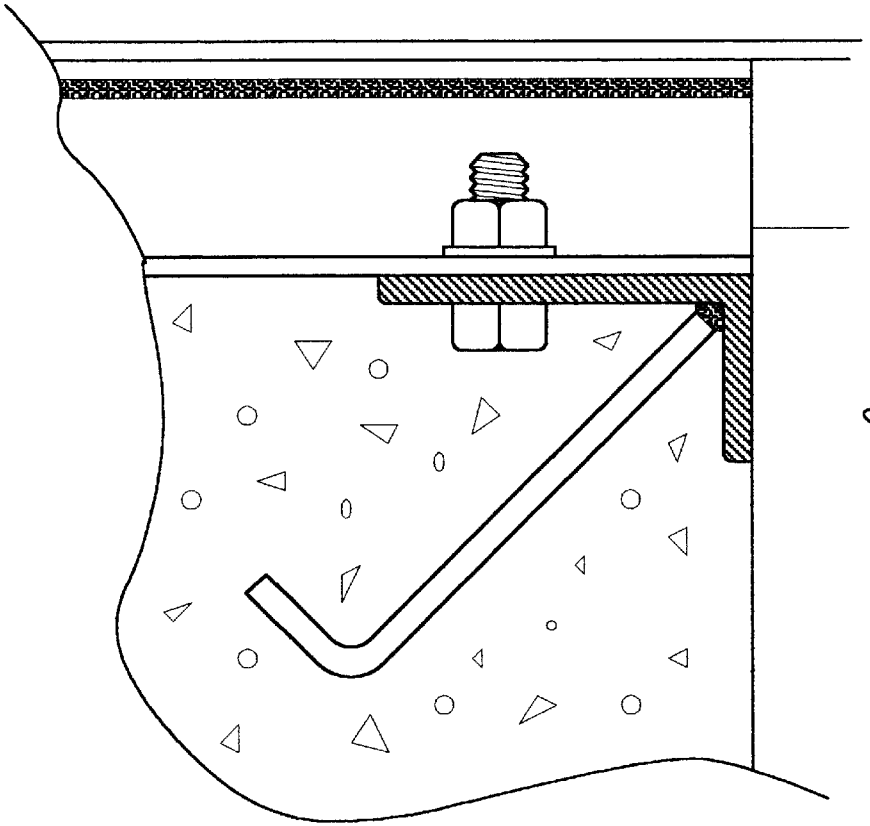
Figure 25:
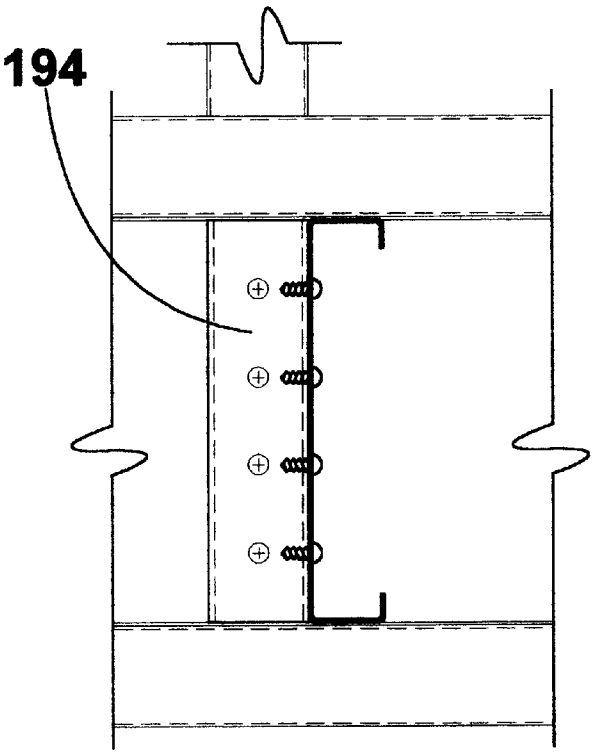
FIGS. 24 and 25 are sectional side elevation, and end elevation views of a junction between a first story and a second story of a building in accordance with this invention.
Figure 24:
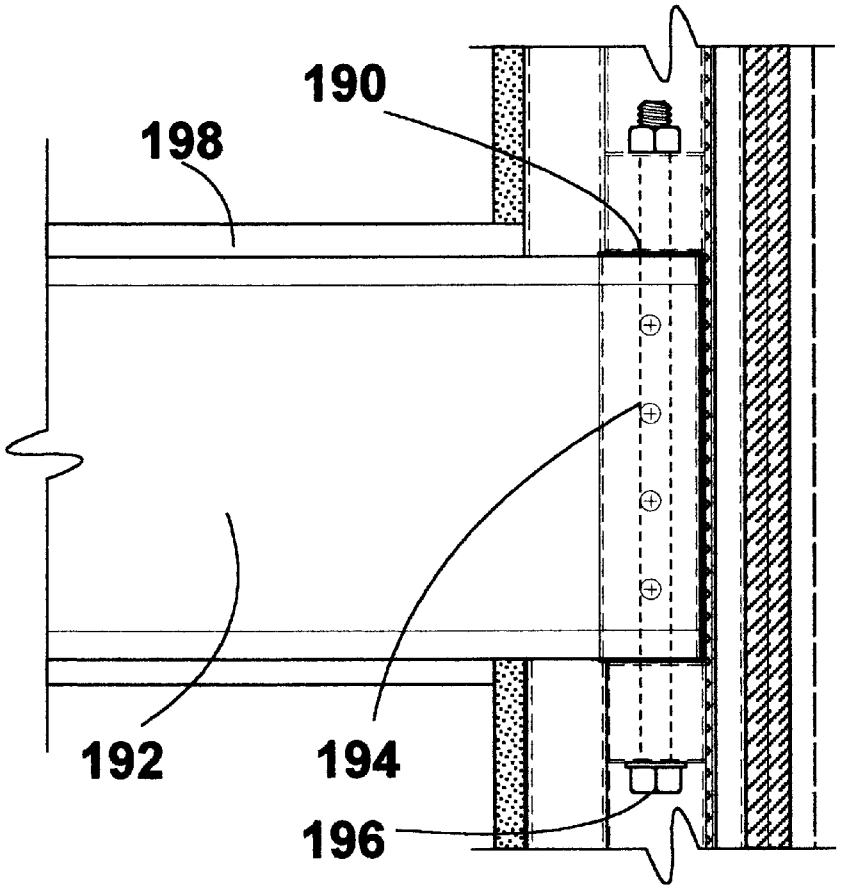

When the floor of the building does not sit on a slab, or when there is more that one story, it is necessary to support one or more floors on floor joists. Two different types of floor joists are shown in FIGS. 20–23, and a second story floor joist treatment is shown in FIGS. 24 and 25. A C-chanel joist is shown in FIGS. 20 and 21, and a bar joist is shown in FIGS. 20A, 22, and 23. The C-channel joist 170 shown in FIGS. 20 and 21 includes a C-channel 172 fastened to an L-bracket 174 by bolts 176. Brackets 174 are bolted or welded to two I-beams 178 (only one of which is shown) that run the length of the foundation 76 and are fastened to anchors 78 secured thereon as previously described. Threaded ends 81 of bolts project up from the anchor and are received through holes in the lower inner flange of the I-beams 178, and receive nuts 83 to hold the I-beam in place. Inwardly opening channel (not shown) with upright 2"×2" steel tubing inserted in the channel at spaced positions therealong could be substituted for the I-beam 178.

The C-Channels 172 are spaced at suitable intervals along the I-beam 178, for example, every 18", and over the end walls of the foundation. Sub-flooring 179 is laid over and supported by the joists 170. Brackets for attaching the wall modules are connected to floor by bolts 180 that are inserted through holes in the I-beam upper inner flange and through the sub-flooring. The wall modules 36 are attached to the brackets in the manner described above.

The bar joist 180 shown in FIGS. 20A, 22 and 23 is a construction of two angle bars 182 welded to angled steel bars 184, inturn welded to a lower angle bar 186 as shown in FIG. 20A. The ends of the bar joist have another pair of angle bars 188 welded to them to serve as a base on which the bar joist 180 can sit on the top of foundation wall 76. The ends of the bar joist 180 lie over the anchor, of which two types are shown in FIGS. 20A and 22, and are fastened thereto by bolts protruding from the anchor above the upper surface of the foundation. The wall modules 36 are fastened to brackets attached by bolts through the sub-floor 179 and the angle bars 182.

A second story can be supported atop the peripheral wall 20 by using a C-track 190 running the length of the two opposite side walls of the peripheral wall frame, and receiving ends of space C-channels 192 therein. Vertically disposed short lengths 194 of 2"×2" steel tubing are fitted into the C-track and attached to the C-track 190 and to the C-channel 192 to secure the C-channel 192 in the C-track 190. The short lengths 194 of 2"×2" steel tubing are also spaced at short intervals along the C-track to support the weight of the second story frame wall thereon. The entire structure is attached together with long bolts 196 which can be positioned to run through the middle of the short lengths 194 of 2"×2" steel tubing. The second story peripheral wall is assembled directly atop the top surfaces of the C-track as shown in FIGS. 24 and 25, or the second story sub-floor 198 can be laid atop the joist and the C-track and the second floor peripheral wall can be assembled on the second story sub-floor 198.

The invention thus enables the low cost construction of a house with design capabilities of meeting the design needs of multiple requirements without major redesign. For example, in areas that have a need for high wind resistance, the diagonal bracing in the horizontal plane of the truss lower chords 96, and in the vertical plane through the truss upper chord apexes can be added to give very strong resistance to the racking forces exerted by wind loads on the peripheral wall 20 and on the trusses 30. In areas where heavy snow loads can be expected, the pitch angle of the trusses can be increased to any desired angle to increase the load bearing strength and the snow shedding capability of the roof. In earthquake prone areas, the diagonal shear panels may be used extensively to give redundant load sharing capability and the horizontal and vertical diagonal truss bracing may be used to prevent the lateral forces of an earthquake from racking the roof trusses in the direction normal to their plane. The roofing material may be selected for minimum weight to minimize the inertial forces so the house moves more like a rigid unit rather than a flexible vertical cantilever. This will minimize the damage to the building caused by differential movement of the foundation and the roof so that the building will remain serviceable after the earthquake. The metal frame building is inherently immune to attacks by termites and carpenter ants as well as mold and mildew, and is inherently resistant to fire damage.

Obviously, numerous modifications and variations of the preferred embodiment disclosed herein are possible and will occur to those skilled in the art in view of this description. For example, many functions and advantages are described for the preferred embodiments, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that these modifications and variations, and the equivalents thereof, are to be considered within the spirit and scope of the invention as defined by the following claims, wherein I claim:

1. An earthquake and wind-resistant building, comprising:

side walls made of side wall frame modules bolted together along adjacent edges, said side wall frame modules constructed of rectangular steel tubing welded together, at least some of said side wall frame modules having diagonal bracing;

end walls made of end wall frame modules bolted together along adjacent edges, said end wall frame modules constructed of rectangular steel tubing welded together, at least some of said end wall frame modules having diagonal bracing;

said end walls each having two ends, each bolted to corresponding ends of said side walls to form a peripheral wall of said building;

pockets in said side walls each defined by a floor and opposed side surfaces extending completely through said side wall from said inside face to said outside face, said floor lying below the top-most surface of said side wall;

trusses for supporting a roof on said peripheral wall, said trusses fixed in said pockets on top of said side walls and extending from said inside face through and beyond said outside face of said side walls, said pockets defined between structural members at the top of said wall, said trusses being bolted between said structural members to secure said roof of said building on said peripheral wall;

anchors set in a concrete foundation and having brackets at the top surface of the foundation positioned thereon adjacent to where bottom longitudinal members of the frame modules lie, and are fastened thereto;

vertically extending studs fastened to inside surfaces of said wall frame modules for attachment of interior wall board;

vertically extending stringers attached to outside surfaces of said wall frame modules for attachment of external siding; and longitudinally extending perlins attached to brackets fixed to said trusses, said perlins extending over said trusses for attachment of roof sheathing.

2. A method of building a frame for a house, comprising:

constructing a plurality of rectangular end wall frame modules and a plurality of rectangular front and back side wall frame modules from rectangular steel tubing welded together using jigs to ensure accurate right angle orientation at all four outside corners of said frame modules;

each of said front and back frame modules having two upright end members, each having upper and lower ends connected at ends of upper and lower longitudinal tube members extending between and connecting said two upright end members, and having a tubular eve strut supported at opposite ends thereof on upright stub supports welded to said upper longitudinal tube member at positions offset inwardly from said upright end members, said stub supports supporting said tubular eve strut at a position spaced above said upper longitudinal tube member;

bolting a rectangular end wall frame module to a rectangular side wall frame module on each corner of said building to make a corner structure;

bolting front and back side wall frame modules between said corner structures at front and back sides of said house, respectively, and bolting end side wall frame modules between said corner structures at ends of said house, respectively, to create a continuous peripheral wall;

constructing a plurality of roof trusses from a plurality of lengths of rectangular steel tubing cut to size and welded together and to overlapping steel plates for strength at two ends and an apex;

constructing a foundation around a perimeter of said house and embedding anchors in said foundation, said anchors including a bracket positioned at the top surface of said foundation inboard from the peripheral edge of said foundation a distance equal to the thickness of said longitudinal tube members said anchor brackets being positioned along said continuous peripheral wall at locations corresponding to junctions of said side wall frame modules and junctions of said front and back side wall frame modules to hold adjacent modules together at lower corners thereof and also secure said lower corners securely to said foundation;

attaching said lower longitudinal tube members of said wall frame modules to said anchor brackets at a position adjacent to said outside peripheral edge of said foundation to secure said building to said foundation;

bolting one each of said trusses between each of said stub supports spanning said front and back side walls, and attaching purlins to an upper chord of said trusses extending thereacross for the full length of said house for attachment of a roof;

attaching stringers to outside surfaces of said peripheral wall and attaching exterior siding to said stringers;

applying vapor barrier material and inserting thermal insulation into said peripheral wall;

attaching vertically extending studs to inside surfaces of said peripheral wall for attaching wall board to said studs;

attaching longitudinally extending channels to a lower chord of said trusses for attaching ceiling wallboard to said channels.

3. A steel building frame, highly resistant to wind loads, comprising:

a peripheral wall frame of said building frame, including a plurality of frame modules, prefabricated from rectangular steel tubing, connected end-to-end at junction lines;

said frame modules having two upright end members and an upper horizontal member supported at the upper ends of said upright end members, and a lower member connected between bottom ends of said upright end members;

a plurality of steel anchors having structure for embedding in a peripheral foundation underlying said peripheral wall frame;

bracket structure connecting bottom ends of said upright end members of adjacent frame modules to each other and to said anchors to hold said frame members together and down against vertical translation away from said foundation, and against lateral translation off of said foundation;

roof trusses supported on said peripheral wall frame at frame module junction lines and bolted to said frame modules;

pockets between upper portions of said peripheral wall frame modules into which said trusses fit and to which said trusses are bolted;

said pockets having an upwardly facing floor for vertically engaging and supporting said roof trusses; said pocket floors lying at a level flush with said upper horizontal members of adjacent frame members and vertically aligned therewith;

whereby a high strength continuous tensile load path exists through steel structure from said foundation to said roof through said anchors and said peripheral wall frame to said trusses.

4. A steel building frame as defined in claim 3, wherein:

said frame modules have two longitudinal ends defined by said upright end members; and said pockets are located directly over two abutting upright end members of adjoining frame modules;

whereby said trusses are vertically supported directly by said upright end members.

5. A steel building frame as defined in claim 3, wherein:

said frame modules are rectangular structures with four outer corners disposed at angles of about 90°±2°;

said frame modules being fabricated from lengths of said steel tubing welded together.

6. A steel building frame, resistant to wind loads, comprising:

a peripheral wall frame of said building frame, including a plurality of frame modules, prefabricated from rectangular steel tubing, connected end-to-end at junction lines;

a plurality of steel anchors having structure for embedding in a peripheral foundation underlying said peripheral wall frame;

said frame modules having lower members connected to said anchors to hold said frame members down against vertical translation away from said foundation, and against lateral translation off of said foundation, said frame modules have two longitudinal ends defined by upright end members;

roof trusses supported on said peripheral wall frame at frame module junction lines and bolted to said frame modules;

pockets between upper portions of said peripheral wall frame modules into which said trusses fit and to which said trusses are bolted;

said pockets are located directly over two abutting upright end members of adjoining frame modules;

said pockets have side edges that are defined by upright stub members welded atop said frame modules adjacent to and spaced from said upright end members by about one half the thickness of said truss, and said stub members on adjoining frame modules are spaced apart a distance about equal to said truss thickness;

whereby said trusses stand upright without bracing when fitted into said pockets during assembly, and said trusses are bolted to both of two adjacent frame modules with a bolt.

7. A steel building frame as defined in claim 6, further comprising:

an eve strut welded between said stub members on at least one of said frame modules and extending longitudinally of said frame module between said stub members.

8. A steel building frame as defined in claim 7, wherein:

said stub members are welded to upper longitudinal frame members of said modules; and said eve strut is spaced above said upper longitudinal frame member, leaving a gap between said eve strut and said upper longitudinal frame member for access to insert and tighten a bolt through said adjacent stub members of adjoining frame modules and through a truss in said pocket between said adjacent stub members.

9. A steel building frame, highly resistant to wind loads, comprising:

a peripheral wall frame of said building frame, including a plurality of frame modules, prefabricated from rectangular steel tubing, connected end-to-end at junction lines;

a plurality of steel anchors having structure for embedding in a peripheral foundation underlying said peripheral wall frame;

said frame modules having lower members connected to said anchors to hold said frame members down against vertical translation away from said foundation, and against lateral translation off of said foundation;

roof trusses supported on said peripheral wall frame at frame module junction lines and bolted to said frame modules;

said anchors each include a bracket having a base and an upstanding flange;

said embedding structure includes a rod projecting downwardly from said base for embedding in said foundation;

said anchors are spaced along said peripheral foundation to coincide with positions of said junction lines of adjacent frame modules for attachment of said modules to said foundation at longitudinal ends of said modules;

whereby a high strength continuous tensile load path exists through steel structure from said foundation to said roof through said anchors and said peripheral wall frame to said trusses.

10. A steel building frame as defined in claim 9, wherein:

each of said anchors includes a single bracket sized to span at least the width of two adjoining upright end members of said wall modules;

whereby said bracket is fastened to both of said adjoining modules to secure them to said foundation and to each other.

11. A steel building frame as defined in claim 10, wherein:

said brackets are fastened to said frame modules by fasteners which extend through aligned holes in said bracket and said upright end frame members.

12. A steel building frame, highly resistant to wind loads, comprising:

a peripheral wall frame of said building frame, including a plurality of frame modules, prefabricated from rectangular steel tubing, connected end-to-end at junction lines;

a plurality of steel anchors having structure for embedding in a peripheral foundation underlying said peripheral wall frame;

said frame modules having lower members connected to said anchors to hold said frame members down against vertical translation away from said foundation, and against lateral translation off of said foundation;

roof trusses supported on said peripheral wall frame at frame module junction lines and bolted to said frame modules;

said anchors include a plate disposed flush with a top surface of said foundation;

said embedding structure includes a rod embedded in said foundation and fastened to said plate;

said anchors are spaced along said peripheral foundation to coincide with positions of said junction lines of adjacent frame modules for attachment of said modules to said foundation at longitudinal ends of said modules; whereby a high strength continuous tensile load path exists through steel structure from said foundation to said roof through said anchors and said peripheral wall frame to said trusses.

13. A steel building frame as defined in claim 12, further comprising:

a plurality of floor joists supported on and spanning open spaces within said foundation, said floor joists secured to said foundation by bolts projecting from said plates into said joists.

14. A steel building frame as defined in claim 13, wherein:

said frame modules are supported atop sand floor joists and bolted thereto, providing a portion of said tensile load path between said foundation and said frame modules.

15. A steel building frame, comprising:

a peripheral wall frame, including a plurality of first floor frame modules, prefabricated from rectangular steel tubing, connected end-to-end at junction lines;

a plurality of steel anchors having structure for embedding in a peripheral foundation underlying said peripheral wall frame, said anchors each include a bracket having a base and an upstanding flange;

said anchors are spaced along said peripheral foundation to coincide with positions of said junction lines of adjacent frame modules for attachment of adjacent ends of two modules to said brackets for anchoring said frames to said foundation at longitudinal ends of said modules;

said first floor frame modules having lower members connected to said anchors to hold said first floor frame members down against vertical translation away from said foundation, and against lateral translation relative to said foundation;

second floor joists supported atop and bolted to said first floor frame modules and spanning spaces within said peripheral wall frame;

said peripheral wall frame including a plurality of second floor frame modules, prefabricated from rectangular steel tubing, and connected end-to-end at junction lines, said second floor frame modules supported atop said second floor joists and bolted thereto;

roof trusses supported on said second floor frame modules over module junction lines and bolted to said frame modules;

whereby a high strength continuous tensile load path exists through steel structure from said foundation to said roof through said anchors and said peripheral wall frame and joists to said trusses.

16. A steel building frame as defined in claim 15, wherein:

said rectangular steel tubing is about 2"×2" in cross section.

17. A steel building frame as defined in claim 15, further comprising:

a plurality of purlins lying atop said trusses at right angles thereto, and attached to brackets prewelded to said trusses, said purlins spaced apart on said trusses sufficiently close together for supporting roof sheathing within commercially acceptable sagging deflections of said sheathing.

18. A steel building frame comprising:

a first floor frame including a plurality of first floor frame modules of a peripheral wall frame, prefabricated from rectangular steel tubing, connected end-to-end at junction lines;

a plurality of steel anchors having structure for embedding in a peripheral foundation underlying said peripheral wall frame;

said first floor frame modules having lower members connected to said anchors to hold said first floor frame members down against vertical translation away from said foundation, and against lateral translation relative to said foundation;

said first floor frame including second floor joists supported by and bolted to said first floor frame modules and spanning spaces within said peripheral wall frame;

said peripheral wall frame including a plurality of second floor frame modules, prefabricated from rectangular steel tubing, and connected end-to-end at junction lines, said second floor frame modules supported atop said first floor frame and bolted thereto;

roof trusses supported on said second floor frame modules over module junction lines and bolted to said frame modules;

pockets between upper portions of said peripheral wall second floor frame modules, said trusses received in said pockets with a snug fit and are bolted therein, said pockets being located directly over and vertically aligned with two abutting upright end members of adjoining frame modules for directly supporting said trusses on said two abutting upright end members;

whereby a high strength continuous tensile load path exists through steel structure from said foundation to said roof through said anchors and said peripheral wall frame to said trusses.

19. A modular building frame, comprising:

side walls made of side wall frame modules made of two horizontally spaced upright end members welded between ends of vertically spaced upper and lower horizontal members, said modules being bolted together along adjacent edges, said side wall frame modules constructed of rectangular steel tubing welded together, at least some of said side wall frame modules having diagonal bracing;

end walls made of end wall frame modules bolted together along adjacent edges, said end wall frame modules constructed of rectangular steel tubing welded together, at least some of said end wall frame modules having diagonal bracing;

said end walls each having two ends, each bolted to corresponding ends of said side walls to form a peripheral wall of said building;

trusses for supporting a roof on said peripheral wall;

pockets between upper portions of said peripheral wall frame modules into which said trusses fit and in which said trusses are fixed;

said pockets having an upwardly facing floor for vertically engaging and supporting said roof trusses; said pocket floors lying at a level flush with said upper horizontal members of adjacent frame members and vertically aligned directly over two abutting upright end members of adjoining frame modules, whereby said trusses are vertically supported directly by said upright end members;

said pockets defined between structural members at the top of said wall, said trusses being bolted between said structural members to secure said roof of said building on said peripheral wall;

vertically extending studs fastened to inside surfaces of said wall frame modules for attachment of interior wall board;

vertically extending stringers attached to outside surfaces of said wall frame modules for attachment of external siding; and longitudinally extending perlins attached to brackets fixed to said trusses, said perlins extending over said trusses for attachment of roof sheathing.

20. A rectangular frame module for a modular building frame side wall having pockets atop said side wall for receiving and securely holding roof trusses upright in said pockets atop said side wall, comprising:

two upright end members, each having upper and lower ends upper and lower longitudinal tube members each having ends welded to said two upright end members and extending between and connecting said upright end members forming a planar rectangle;

a tubular eve strut welded at opposite ends thereof to upright stub supports, which are welded to said upper longitudinal tube member at positions offset inwardly from said upright end members, said stub supports supporting said tubular eve strut at a position spaced above said upper longitudinal tube member;

vertically extending studs fastened to inside surfaces of said wall frame modules for attachment of interior wall board; and vertically extending stringers attached to outside surfaces of said module for attachment of external siding;

whereby a plurality of said rectangular frame modules may be bolted together edge-to-edge to form said side walls, with said pockets defined between adjacent upright stub supports of adjacent frames to receive and support said trusses.

21. A rectangular frame module as defined in claim 20, wherein:

said upright end members have holes predrilled therein on axes lying the plane of said planar rectangle, said predrilled holes being positioned vertically in said upright end members to correspond to holes predrilled in other frame modules to allow insertion of bolts through said holes whereby said modules may be fastened together edge-to-edge to form said side wall; and said upright stub supports have holes predrilled therein on axes lying in the plane of said planar rectangle, said predrilled holes being positioned vertically in said upright stub supports to align with holes predrilled in upright stub supports of adjacent frame modules to allow insertion of bolts through said holes whereby said trusses may be fastened in said pockets.

* * * * *